US009939241B2

(12) United States Patent
Skiles et al.

(10) Patent No.: US 9,939,241 B2
(45) Date of Patent: Apr. 10, 2018

(54) COATED SUBSTRATE SYSTEMS AND METHODS

(71) Applicant: ALCOA INC., Pittsburgh, PA (US)

(72) Inventors: Jean Ann Skiles, Gibsonia, PA (US); Charles Warren, Sarver, PA (US); Heather Drieling, Apollo, PA (US); John McAllister, New Kensington, PA (US); Tom Murphy, Jeanette, PA (US); James Wiswall, Pittsburgh, PA (US)

(73) Assignee: ARCONIC INC., Pittsburgh, PA (US)

( * ) Notice: Subject to any disclaimer, the term of this patent is extended or adjusted under 35 U.S.C. 154(b) by 0 days.

(21) Appl. No.: 14/939,665

(22) Filed: Nov. 12, 2015

(65) Prior Publication Data

US 2016/0131461 A1 May 12, 2016

Related U.S. Application Data

(60) Provisional application No. 62/078,633, filed on Nov. 12, 2014.

(51) Int. Cl.
*F42B 33/14* (2006.01)
*F42B 5/295* (2006.01)

(52) U.S. Cl.
CPC ..... *F42B 33/14* (2013.01); *F42B 5/295* (2013.01)

(58) Field of Classification Search
CPC ..... F42B 33/14; F42B 5/295; F42B 5/297
See application file for complete search history.

(56) References Cited

U.S. PATENT DOCUMENTS 2,972,947 A * 2/1961 Fitzsimmons ..... F42B 5/295 102/465
3,034,433 A * 5/1962 Gronn ..... F42B 5/295 102/464
3,448,055 A * 6/1969 Mickelson ..... C23G 1/125 134/3
3,752,080 A * 8/1973 Weyhmuller ..... F42B 5/295 102/464
3,830,157 A * 8/1974 Donnard ..... F42B 5/295 102/464
4,041,868 A * 8/1977 Rayle ..... F42B 5/28 102/468

(Continued)

FOREIGN PATENT DOCUMENTS

EP 2253925 A2 * 11/2010 ..... F42B 5/295

OTHER PUBLICATIONS

PolarTherm Boron Nitride Powder, Sep. 2012, Momentive Performance Materials Inc.*

(Continued)

*Primary Examiner* — Stephen Johnson
*Assistant Examiner* — Joshua T Semick
(74) *Attorney, Agent, or Firm* — Greenberg Traurig, LLP

(57) ABSTRACT

An apparatus, comprising: a substrate configured into a casing, a propellant configured between a projectile positioned/configured within the casing and an end of the casing, the propellant configured to expand upon a firing event and project the projectile from the casing; and a coating comprising a conformal coating layer having a particulate boron nitride dispersed therein, wherein the coating is configured to cover at least one of the inner sidewall and the outer sidewall, such that at least one side of the substrate is covered by the coating.

35 Claims, 16 Drawing Sheets

(56) References Cited

U.S. PATENT DOCUMENTS

| | | | | |
|---|---|---|---|---|
| 4,688,465 | A * | 8/1987 | Melhus | F42B 33/025 102/430 |
| 5,783,308 | A * | 7/1998 | Leendersen | C08K 3/38 428/422 |
| 6,291,054 | B1 * | 9/2001 | Thomas | A47J 36/02 427/384 |
| 7,662,324 | B2 * | 2/2010 | Pruss | C08J 9/0066 264/176.1 |
| 9,254,503 | B2 * | 2/2016 | Ward | B05D 1/36 |
| 2014/0224144 | A1 * | 8/2014 | Neugebauer | F42B 5/285 102/470 |

OTHER PUBLICATIONS

Chkhartishvil, Levan, "Morphology model for nano-powdered boron nitride lubricants", Jan. 2012, ResearchGate.*

* cited by examiner

Figure 3A Unfired 0.40 Caliber Cases Showing Intentional Damage to Facilitate Leakage and Burn Through:

Figure 3B – Fired 0.40 Cal. aluminum cases with 0.015 inch diameter holes. Case in center has coating containing hBN flakes with aligned orientation and displays less damage than flanking cases coated with randomly oriented hBN flakes.

LEAU 500 hBN PUHP 1106 hBN PUHP 500 hBN hBN e.g. LEAU 500 Field 1, SEM hBN e.g. PUHP 1106 Field 3, SEM 0.025 inch hole: bare brass 0.025 inch hole: type III anodized aluminum 0.025 inch hole: bare aluminum 0.0625 inch hole: bare brass 0.0625 inch hole: type III anodized aluminum 0.0625 inch hole: Bare aluminum

COATED SUBSTRATE SYSTEMS AND METHODS

CROSS-REFERENCE TO RELATED APPLICATIONS

This application is a non-provisional of and claims priority to U.S. Application Ser. No. 62/078,633 entitled "Coated Substrate Systems and Methods" filed on Nov. 12, 2014, which is incorporated by reference in its entirety.

FIELD OF THE INVENTION

Broadly, the instant disclosure is directed towards utilizing ammunition cartridge casings. More specifically, the instant disclosure is directed towards different embodiments of utilizing coating systems to protect various case materials ("substrates") utilized in ammunition casings including aluminum.

BACKGROUND

Aluminum is utilized as a material in certain ammunition cartridge cases. Aluminum utilization has not been more widespread vs. other materials (such as brass) since a compromised case can react with the hot gases leaking out of the case during a firing event. Such a reaction is known as a "burn-through". Instances of imperfections in manufacturing a cartridge case can provide a compromised case, where the imperfection can be an initiation site for a burn-through event. Burn through is a failure mode in which high temperature and pressure gas flows ("escapes") and mix with substrate particles (parts of the case) due to erosion to the case surface from the jet of gas which, in turn, fuels the release of further energy. A burn through event can damage the weapon and/or injure the operator.

SUMMARY OF THE DISCLOSURE

With one or more embodiments of the instant disclosure, burn through is reduced, prevented, and/or eliminated for coated cartridge casings utilized in small caliber rounds, even the more powerful firing events for rifle ammunition involving sufficient pressure, time duration, and high temperature and operator exposure that formerly caused aluminum usage to be proscribed as a case material in these applications.

With one or more embodiments of the instant disclosure, burn through is reduced, prevented or eliminated for numerous other applications involving substrate materials that are exposed to high temperature and pressure gas ("plasma") streams for brief time durations that encompass an entire firing event.

Broadly, the present disclosure relates to protecting surfaces from brief (1-5 millisecond), one-time, high temperature (>2000° C.) exposures which would otherwise damage the surface and the underlying material.

In a short duration event, the transient thermal response of the substrate with its protective coating is the important quantitative information required to compare different candidate materials and engineer the minimum coating thickness for those materials. A thermal model was used to estimate the time until the substrate material exceeds its thermal limit and to engineer the coating thickness for a particular coating and substrate material combination.

In one or more embodiments, of the instant disclosure, the casing system (substrate and coating) is configured to reduce, prevent, and/or eliminate the ignition of the substrate (e.g. aluminum) in a rifle case (e.g. 5.56 mm ammunition case). In some embodiments, the coating comprises a conformal coating.

As used herein, "conformal coating" means: a coating that adheres to a surface. In some embodiments, the conformal coating is configured to spread over the surface to facilitate complete covering and/or encapsulation of the surface (e.g. spreads into the nooks and crannies).

In some embodiments, the coating is configured to promote lubricity with the barrel (e.g. to allow for smooth action within the weapon).

In some embodiments, the coating is configured to promote high temperature resistance with sufficient coating thickness to prevent the substrate material from becoming damaged if it had a flaw (e.g. manufacturing defect, or as the result of handling).

In one aspect, an apparatus is provided, comprising: a substrate configured into a casing, the casing having at least one sidewall such that the casing includes an inner sidewall and an outer sidewall, the casing configured such that it has two opposing ends: a first open, (mouth) end and a second closed, (head) end; a projectile configured to sit within and be retained by the casing and positioned adjacent to the first end (mouth); a propellant, the propellant configured between the projectile and the second end (head end) of the casing, the propellant configured to expand upon a firing event and project the projectile from the casing; and a coating comprising a thermal resistant conformal coating, which can be organic, inorganic, polymer or a combination, which provides a thermal and chemical protecting barrier layer, wherein the coating is configured to cover at least one of the inner sidewall and the outer sidewall, such that at least one side of the substrate is covered by the coating.

In some embodiments, the coating is configured to cover the inner sidewall and outer sidewall of the casing such that the casing is encased within the coating. In some embodiments, the coating is configured to cover the inner sidewall and outer sidewall of the casing such that the casing is entirely encapsulated by the coating layer.

In some embodiments, the casing comprises an ammunition cartridge case.

In some embodiments, the casing comprises a rim-fired ammunition casing.

In some embodiments, the casing comprises a center-fired ammunition casing.

Some non-limiting examples of center-fired ammunition casings are: 5.56 mm NATO; .223 Remington; 9 mm; .40 Caliber S&W; or a .45 ACP.

Some non-limiting examples of high-powered rifles ammunition casings include: 5.56×45 mm NATO, .223 Remington, 30-06 Springfield (7.62×63 mm), 7.62×51 mm NATO, 308 Winchester, .50 BMG (7.72×99 mm).

One or more coating systems of the instant disclosure are configured to be used with aluminum pistol rounds including but not limited to: .45 ACP, .40 Smith & Wesson, 10 mm Auto, .357 Magnum, 38 Special, 9 mm Parabellum, and the .25 Auto. In some embodiments, the casing comprises power capsule ("squib") for a propellant-operated power tool or other device.

In some embodiments, the substrate is selected from the group consisting of: aluminum, aluminum alloys (e.g. 2xxx, 6xxx, and 7xxx series aluminum alloys, 2024, 6055, 7075, 7085), magnesium, titanium, steel, plastic, and polymers.

In some embodiments, the substrate comprises a pipe (e.g. mining pipe, chemical pipe).

In some embodiments, the substrate comprises a power capsule ("squib") for a propellant-operated device such as: an occupant-restraint air bag assembly in an automotive vehicle.

In some embodiments the substrate comprises a surface exposed to a brief (1-3 millisecond), one-time thermal event involving a gas jet at a temperature of at least 2500° C.

In one aspect, an apparatus is provided, comprising: a substrate configured into a casing, the casing having at least one sidewall such that the casing includes an inner sidewall and an outer sidewall, the casing configured such that it has two opposing ends: a first end and a second end; a projectile configured to sit within and be retained by the casing and positioned adjacent to the first end; a propellant, the propellant configured between the projectile and the second end of the casing, the propellant configured to expand upon a firing event and project the projectile from the casing; and a coating comprising a fluoropolymer layer having a particulate boron nitride therein (e.g. dispersed therein), wherein the coating is configured to cover at least one of the inner sidewall and the outer sidewall, such that at least one side of the substrate is covered by the coating.

In one aspect, an apparatus is provided, comprising: an ammunition cartridge casing comprising a substrate configured to retain a projectile and a propellant, wherein the ammunition cartridge casing is configured with a coating thereon, wherein the coating includes: a conformal coating portion and an additive configured to be dispersed within the conformal coating portion.

In some embodiments, the conformal coating portion is configured to cover the substrate (e.g. completely encase the substrate).

In some embodiments, the conformal coating comprises a fluoropolymer.

In some embodiments, the additive comprises a ceramic additive.

In some embodiments, the ceramic additive is selected from the group consisting of: alumina, boron nitride, titania, and combinations thereof.

In some embodiments, the additive is present in a range of: at least 5 wt. % to not greater than 70 wt. %. In some embodiments, the additive is present in a range of: at least 15 wt. % to not greater than 50 wt. %. In some embodiments, the additive is present in a range of: at least 30 wt. % to not greater than 50 wt. %. In some embodiments, the additive is present in a range of: at least 35 wt. % to not greater than 45 wt. %.

In some embodiments, the additive is present in a content of: at least 5 wt. %; at least 10 wt. %; at least 15 wt. %; at least 20 wt. %; at least 25 wt. %; at least 30 wt. %; at least 35 wt. %; at least 40 wt. %; at least 45 wt. %; at least 50 wt. %; at least 55 wt. %; at least 60 wt. %; at least 65 wt. %; or at least 75 wt. %.

In some embodiments, the additive is present in a content of: not greater than 5 wt. %; not greater than 10 wt. %; not greater than 15 wt. %; not greater than 20 wt. %; not greater than 25 wt. %; not greater than 30 wt. %; not greater than 35 wt. %; not greater than 40 wt. %; not greater than 45 wt. %; not greater than 50 wt. %; not greater than 55 wt. %; not greater than 60 wt. %; not greater than 65 wt. %; or not greater than 75 wt. %.

In some embodiments, the casing (e.g. ammunition cartridge with coating) is capable of withstanding pressure during a firing event yielding a pressure of at least 40 ksi.

In some embodiments, the casing (e.g. ammunition cartridge with coating) is capable of withstanding a firing event duration of at least 2.2 ms.

In some embodiments, the ammunition cartridge casing is capable of withstanding a temperature during a firing event of not greater than 3000° C.

In some embodiments, the coating is a sacrificial coating (i.e. is lost/burned off as a result of the firing event).

In some embodiments, the coating is configured on the outside surface of the case.

In some embodiments, the coating is configured on the inside surface of the case.

In some embodiments, the coating is configured to encase the substrate (e.g. completely cover and surround the inside, outside, and upper lip/opening, along with base of the case). In some embodiments, the coating is configured to entirely encapsulated by the coating layer.

In some embodiments, the additive comprises a particulate material. In some embodiments, the particulate material comprises a ceramic particulate material.

In some embodiments, the additive comprises a particulate refractory material (e.g. typically utilizable in a high temperature application). In some embodiments, the additive comprises refractory materials having low thermal diffusivity and high temperature and chemical corrosion resistance.

In some embodiments, the additive is selected from the group: alumina, titania, zirconia, boron nitride, cubic boron nitride, hexagonal boron nitride, boron nitride polymorphs, silica ($SiO_2$), silicon carbide (SiC), chromia ($Cr_2O_3$), tungsten carbide, halfnium carbide, tantalum carbide, tantalum-halfnium carbide, and combinations thereof.

In some embodiments, the additive comprises uniformly sized granules.

In some embodiments, the additive comprises non-uniformly sized granules.

In some embodiments, the coating thickness ranges from 0.25 mil to 2.0 mil thick on a single substrate (casing). In some embodiments, the average coating thickness is between 0.25 mil and 2.0 mil.

In some embodiments, the coating thickness ranges from 1.5 mil to 2.0 mil thick.

In some embodiments, the average coating thickness is: at least 0.25 mil; at least 0.5; at least 0.75 mil; at least 1 mil; at least 1.25 mil; at least 1.5 mil; at least 1.75 mil; at least 1.75 mil thick; or at least 2 mil thick.

In some embodiments, the coating thickness is: not greater than 0.25 mil; not greater than 0.5 mil; not greater than 0.75 mil; not greater than 1 mil; not greater than 1.25 mil; not greater than 1.5 mil; not greater than 1.75 mil; not greater than 1.75 mil thick; or not greater than 2 mil thick.

In some embodiments, the additive comprises a spherical shape (e.g. particulate or powder).

In some embodiments, the additive comprises a plate-like shape (e.g. particulate or powder).

In some embodiments, the additive comprises a polygonal cube shape (particulate or powder).

In some embodiments, the additive comprises a prismatic shape (e.g. with an aspect ratio of approximately 1.0), possibly in particulate or powder forms.

In some embodiments, the additive comprises a whisker shape (e.g. thin-rod shaped, fibers, or particulate form).

In some embodiments, the additive comprises a discoidal shape (e.g. circular flat shape).

In some embodiments, as qualified or quantified via visual observation, the casing does not exhibit a burn through event.

In some embodiments, as qualified or quantified via visual observation, the casing does not exhibit significant erosion of the substrate, and therefore does not add the eroded material to the gas stream as combustible material.

In some embodiments, as qualified or quantified via visual observation, the casing does not exhibit melting.

In some embodiments, the coating is configured to insulate the substrate from the heat and pressure of the firing event.

In some embodiments, the coating is configured to isolate the substrate from contact with the gas released during the firing event (i.e. gas caused by ignition of propellant).

In some embodiments, the coating comprises an organic conformal coating.

In some embodiments, the coating comprises a fluoropolymer.

In some embodiments, the coating comprises a fluoropolymer, a solvent/carrier liquid, and at least one additive.

In one aspect, an apparatus is provided, comprising: a cartridge case comprising a substrate (e.g. Al, Ti, brass, steel, plastic), the cartridge case having: a base, a perimetrical sidewall configured to surround the base and extend upward from the base, and an open, upper end, and a coating on the base and the perimetrical sidewall of the cartridge case; wherein, via the coating, the cartridge case does not exhibit burn-through during a firing event that has a duration of greater than two milliseconds, where the firing event produces a gas having pressure of at least 40 ksi and a temperature not greater than 3000° C.

In one aspect, a method is provided comprising: forming a cartridge casing from a substrate material to provide a body having at least one sidewall, the cartridge casing having a first end and a second end, wherein the cartridge casing is configured to retain a projectile and a propellant; coating a cartridge casing with a layer of organic conformal coating including a ceramic particulate dispersed therein; drying (curing) the coating to remove a solvent from the coating and set the coating onto the surface of the substrate (e.g. inner sidewall and/or outer sidewall); positioning the propellant and the projectile within the casing; forming an ammunition cartridge.

In some embodiments, coating (e.g. the step of positioning/depositing the coating on the substrate/case) comprises: spraying, dipping, brushing/painting, rolling, and combinations thereof.

In some embodiments, the method comprises cleaning the surface of the substrate prior to coating the substrate with an organic conformal coating (i.e.: fluoropolymer).

In some embodiments, the method comprises deoxidizing the surface of the substrate (e.g. when the substrate is an aluminum alloy) prior to coating the substrate with an organic conformal coating.

In some embodiments, the coating including a ceramic additive, comprises an orientation of the ceramic additive particles within the coating, wherein the orientation is configured to impart thermal protection and/or insulation to the substrate. In some embodiments, the ceramic additive (e.g. hBN) is plate-like (e.g. flat).

In some embodiments, the coating comprises an organic conformal coating comprising a hexagonal boron nitride with a flat orientation (e.g. 1106 hBN) against the substrate surface.

In some embodiments, the coating comprising a ceramic additive is configured to lie in a flat orientation, parallel to the surface of the case. In some embodiments, hexagonal boron nitride (PUHP 1106) is configured in a flat plate configuration, such that it lies in a substantially flat configuration, such that the plates are configured parallel to the surface of the substrate.

Various ones of the inventive aspects noted hereinabove may be combined to yield coating systems that provide at least one of: insulation of the underlying substrate from surrounding pressure and temperature gradients and isolation of the underlying substrate from direct contact with the hot gases associated with a high temperature/high pressure event (e.g. firing event).

These and other aspects, advantages, and novel features of the invention are set forth in part in the description that follows and will become apparent to those skilled in the art upon examination of the following description and figures, or may be learned by practicing the invention.

BRIEF DESCRIPTION OF THE DRAWINGS

FIG. 3A depicts intentional damage imparted on the shell casings in order to facilitate a propagation site for burn through (and evaluation of the various coating systems to reduce, prevent, and/or eliminate burn through).

FIG. 3A depicts a coating comprising an "aligned" hBN (PUHP 1106) (i.e. aligned in a flat configuration) and where FIG. 3B depicts a coating comprising a non-aligned hBN (LEAU500) (i.e. aligned "randomly").

Referring to FIG. 4A, data is included for both the non-aligned hBN as well as the aligned hBN flakes. Without being bound by a particular mechanism or theory, these simulations provide analytical support to the potential mechanism that the orientation of the plate-like particles on the surface of the substrate contribute to the amount of thermal protection (i.e. insulation) imparted to the substrate via the coating, as compared to a randomly aligned particle/flake.

FIG. 4B shows both aligned (parallel) hBN and random oriented hBN; note that there is a lower, flatter curve for the parallel oriented hBN than random hBN (lower and flatter is the desired trend that gives longer delay time prior to melting or anything else bad happening to the case substrate).

In the adjusted weight loss charts (i.e. FIGS. 6 and 8), the net weight loss is set to zero for the undrilled cases in the adjusted weight loss chart series. Referring to the tables, the adjusted weight loss amount depicts the 45% hBN coated 5.56 case appear to perform slightly worse than Type III Anodized control (i.e. with the 0.030 drilled (small) hole). Without being bound by a particular mechanism or theory, it is believed that in some embodiments, significant weight loss can occur in the hBN coated cartridge cases where there is no burn through event. In some embodiments, the hBN in FP coating is configured to perform as a sacrificial coating, in that it is configured to erode away during a firing event in the immediate area of a manufacturing defect (i.e. the holes in damaged cases). Upon visual observation and inspection of these cases, in many instances the cases remained intact with no visual indication of a burn through event, though weight loss occurred to the case (based on the loss (erosion) of the coating pursuant to the firing event). In contrast, the control (i.e. Type III Anodized coated cases) are configured as a hard surface treatment on the case that is not configured as a sacrificial coating. Thus, the control (Type III anodized cases) do not typically exhibit a large degree of exhibit weight loss outside of a burn-through event. In a burn-through event, if even a small portion of the anodized coating is compromised, burn through propagates significantly through the cartridge case substrate resulting in a large weight loss.

Referring to FIGS. 11 and 12, comparative photos of fired cases are provided, in which the fluoropolymer +hBN coatings are compared to the control casings (Type III anodized). Slight surface unevenness/discoloration is depicted in the coatings with hBN, which the Type III control casings exhibit a large amount of burn-through. FIGS. 11 and 12 contain photographs illustrating the coating weight loss in the vicinity of the damage (hole) for the System C coatings (fluoropolymer with 45 wt. % hBN), which (without being bound by a particular mechanism or theory, are believed to sacrifice part of their thickness and incur weight loss through the function of preventing a burn through event/burning of the substrate. In contrast, the anodized surface of the anodized cases (control, Type III Anodized cases) remains on the case, unless/until a critical point (temperature, pressure) is reached (i.e. during a firing event) at which point the anodized surface yields, the substrate melts, and a burn through event carries both the anodized coating and substrate into the gas stream.

DETAILED DESCRIPTION

Figure 1:
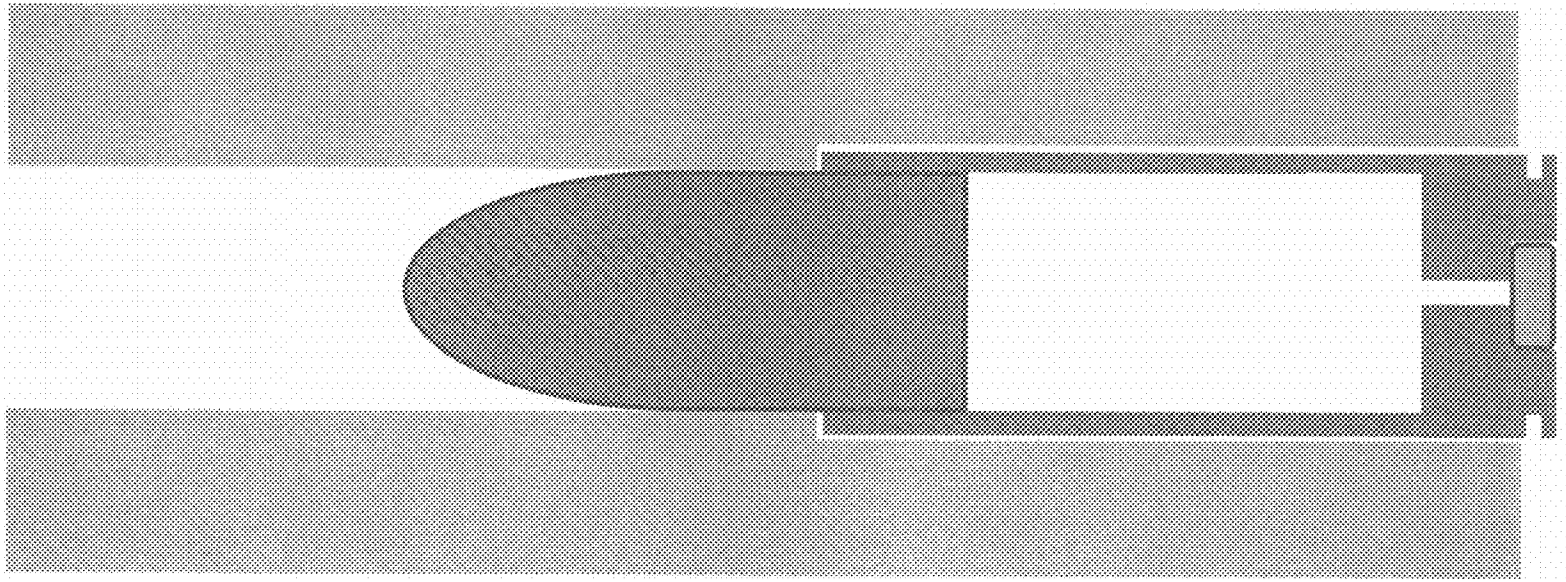
FIG. 1 depicts a schematic cut-away side view of an embodiment of an apparatus (e.g. an ammunition cartridge) positioned within the chamber of a device (e.g. a firearm) prior to a firing event.
Figure 2:
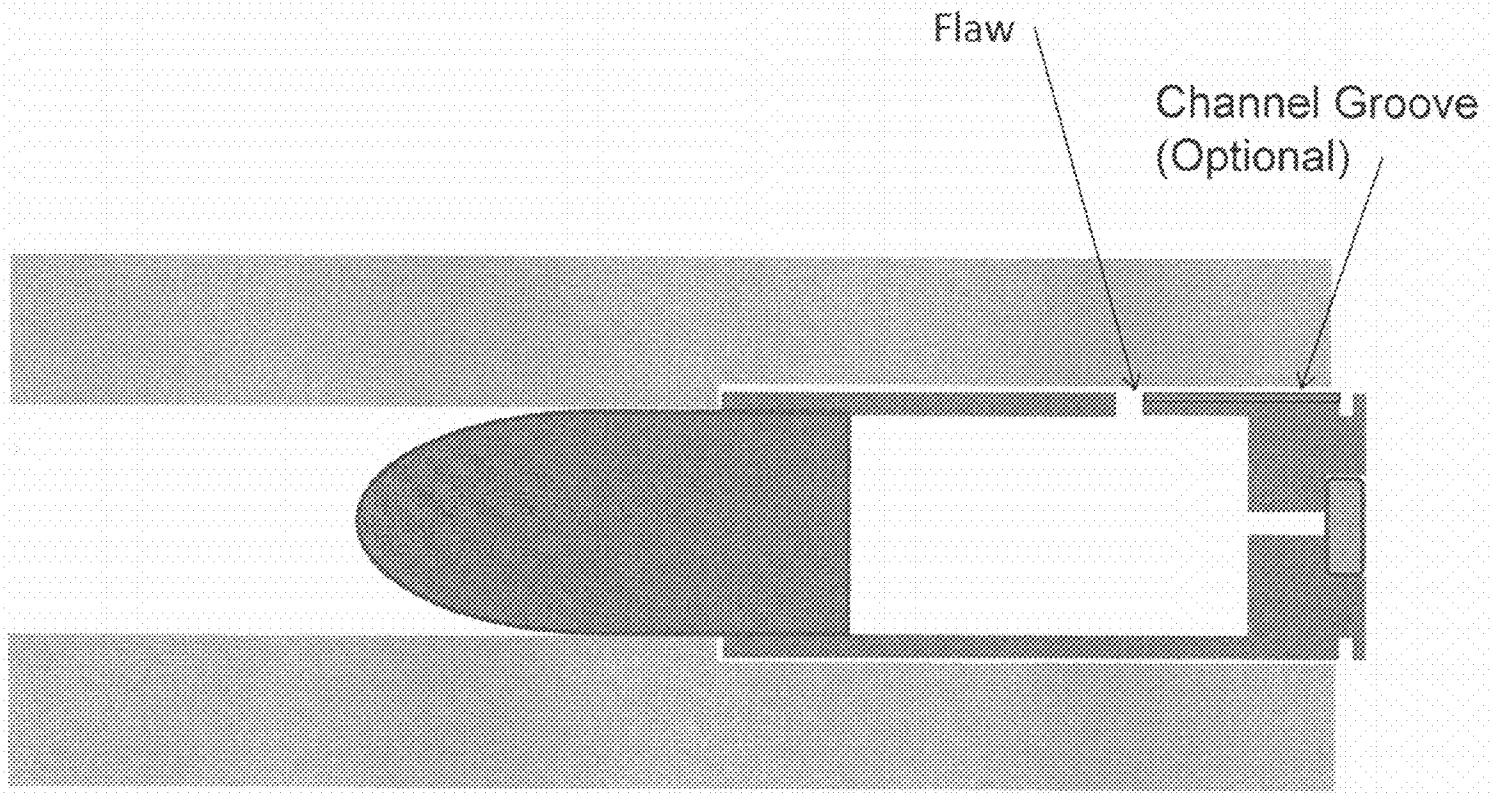
FIG. 2 depicts a schematic cut-away side view of an embodiment of an apparatus (e.g. an ammunition cartridge) with at least one defect in the case (labeled as "flaw" and/or optional "channel/groove"), with the cartridge positioned within the chamber of a device (e.g. firearm) configured to fire the apparatus. This type of apparatus was evaluated in accordance with various embodiments of the instant disclosure, with further detail provided herein.
Figure 3A:
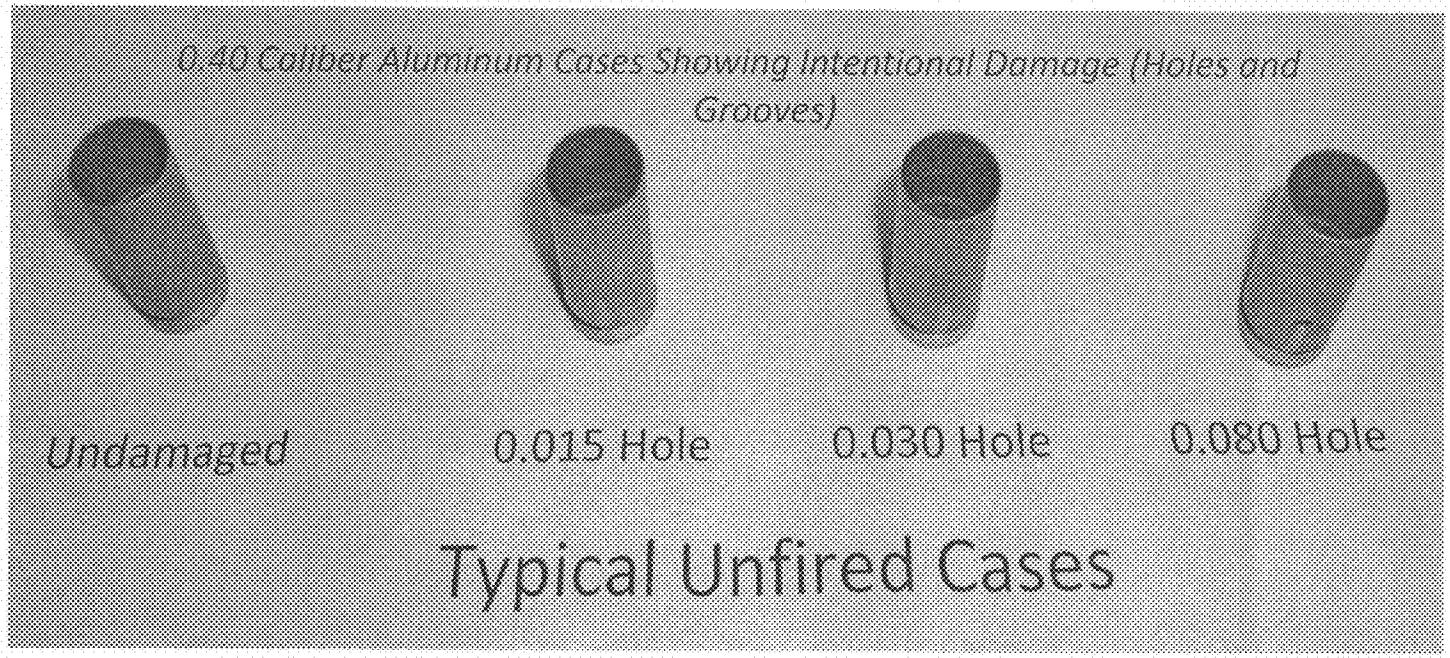
FIG. 3A is a photograph depicting some experimental results regarding some embodiments of the instant disclosure, showing the .40 caliber test cases; undamaged (unfired) and with the various size holes and grooves along the sidewall.
Figure 3B:
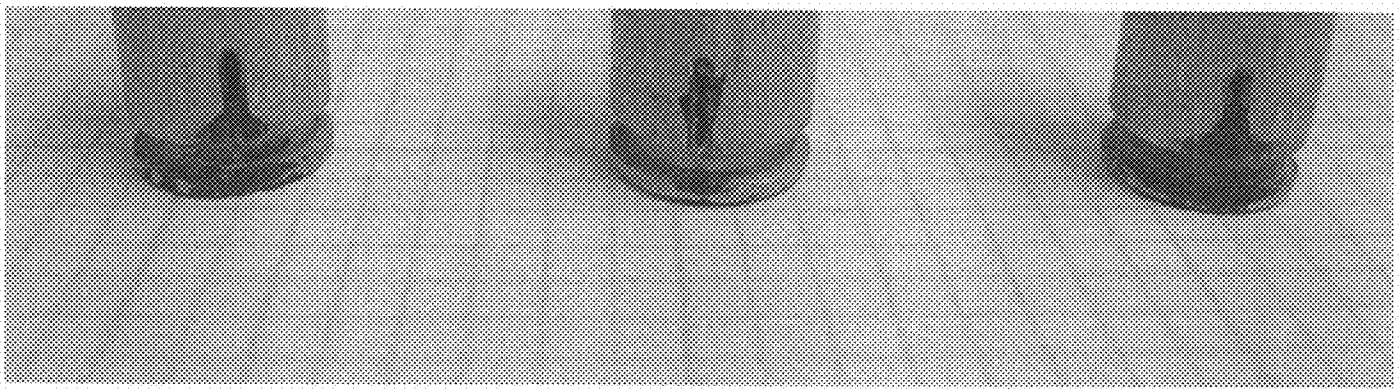
FIG. 3B is a photograph depicting examples of some experiments performed on various embodiments of the instant disclosure. Specifically, of three .40 cal. cases with small hole damage (0.015 inch diameter holes), which are believed to be representative shots from the .40 caliber trial, illustrating the differences (e.g. typical visually observed burn through in the fired case) for three types of hBN coatings added to fluropolymer: 1106 hBN; LEAU500 hBN; and PUHP500hBN. As depicted in FIG. 3B, the 1106 hBN shows less damage than both the LEAU500 hBN and the PUHP500 hBN. The center shell is of a coating having flat orientated hBN flakes/plates; while the cases on either side (i.e. flanking cases) have an hBN coating with randomly oriented hBN flakes/plates.
Figure 3D:
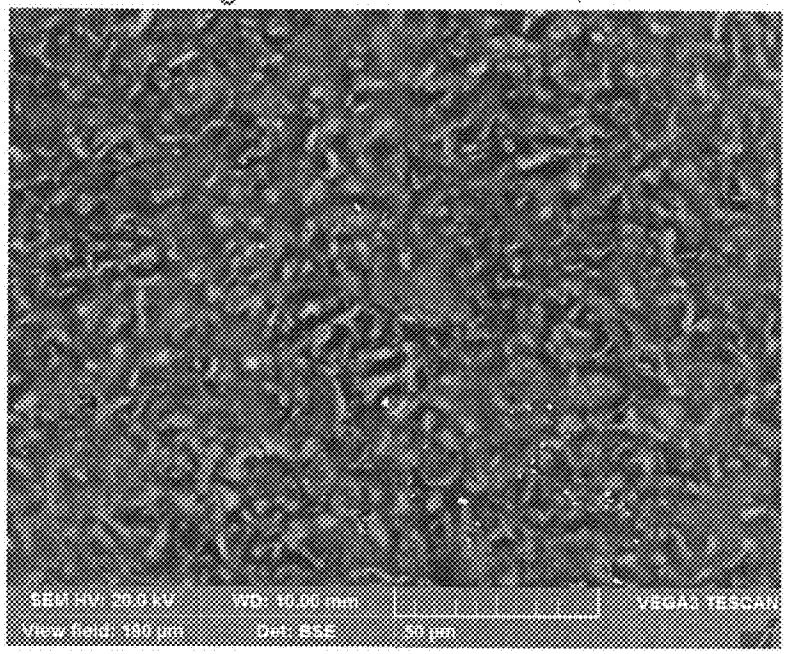
FIGS. 3C and 3D are SEM photographs of two different embodiments of the instant disclosure, in which hBN compositions utilized in coating systems, where
Figure 3C:
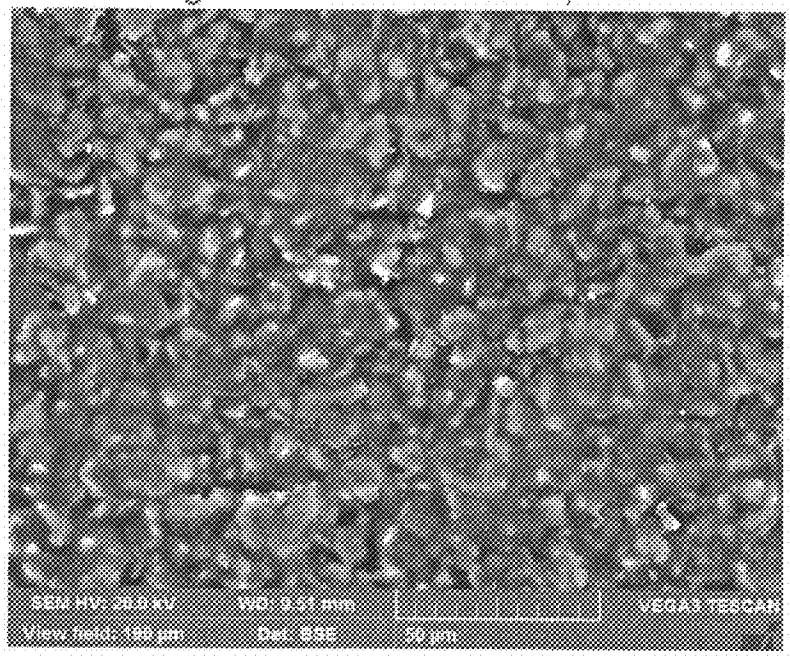
Figure 4A:
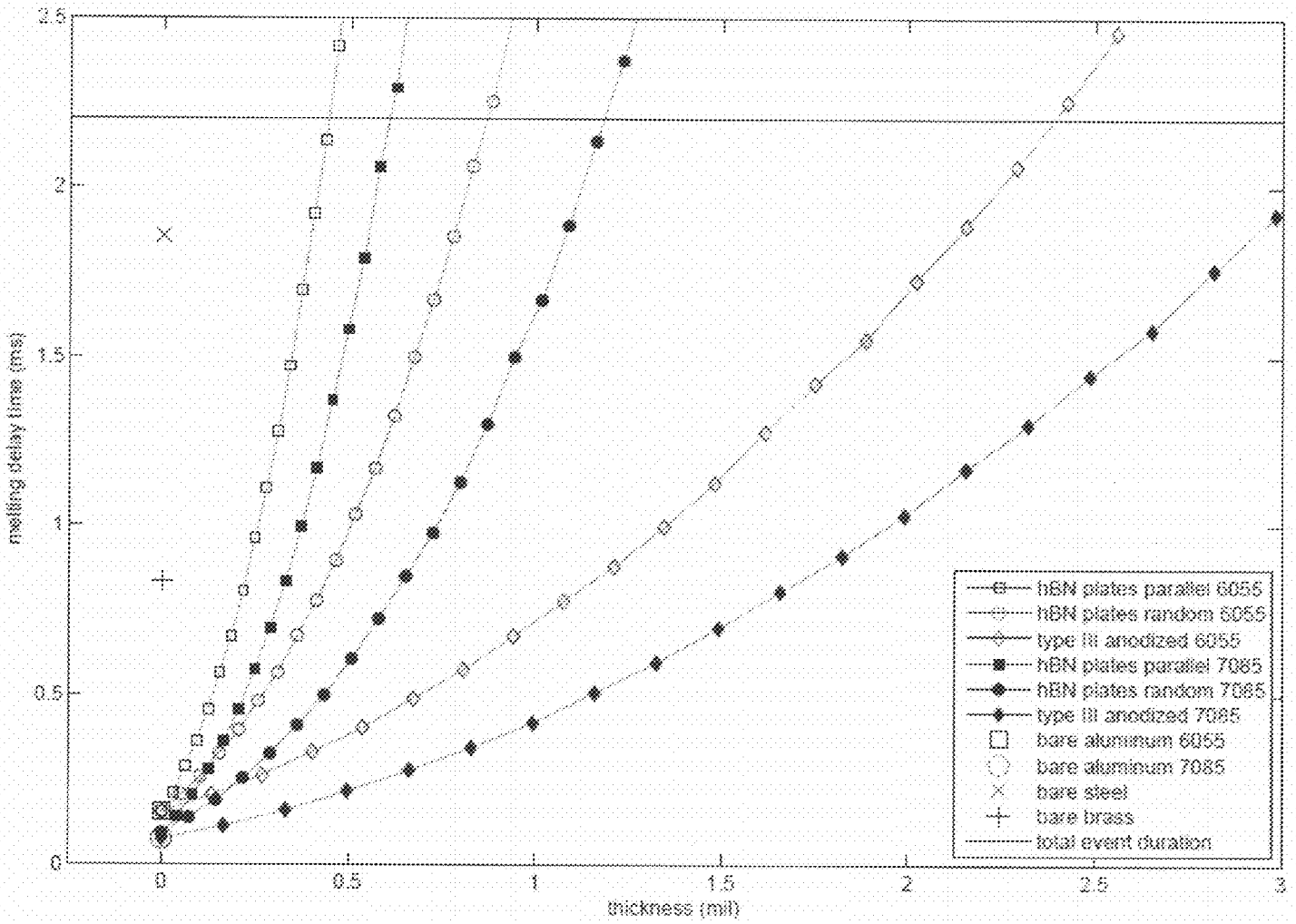
Referring to FIG. 4A, computer simulations were generated in order to compare the thermal calculations for several coatings (depicted as time vs. temperature) employed in various embodiments and controls/comparisons in accordance with the instant disclosure.
Figure 4B:
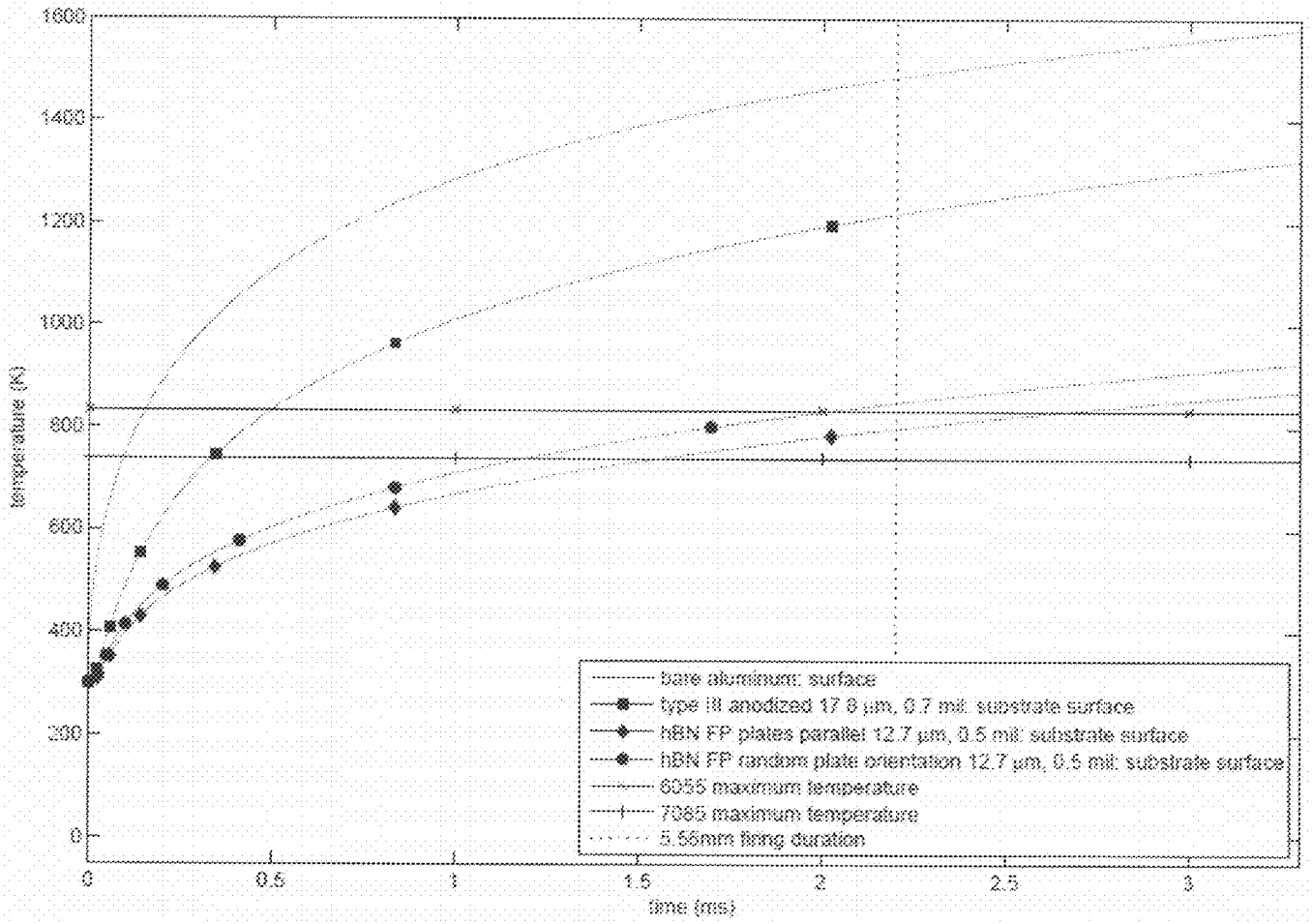
FIG. 4B is a graph depicting case melting delay time (ms) vs. coating type and thickness (um), obtained via computer modeling of the coating systems of various embodiments and control runs in accordance with the instant disclosures compared to the control Type III anodized coating, depicting four different substrates (AA6055 and AA7085, brass and steel) having coatings containing hBN with two orientations (random and oriented parallel to surface), and vs. Type III hard anodized coating.
Figure 4C:
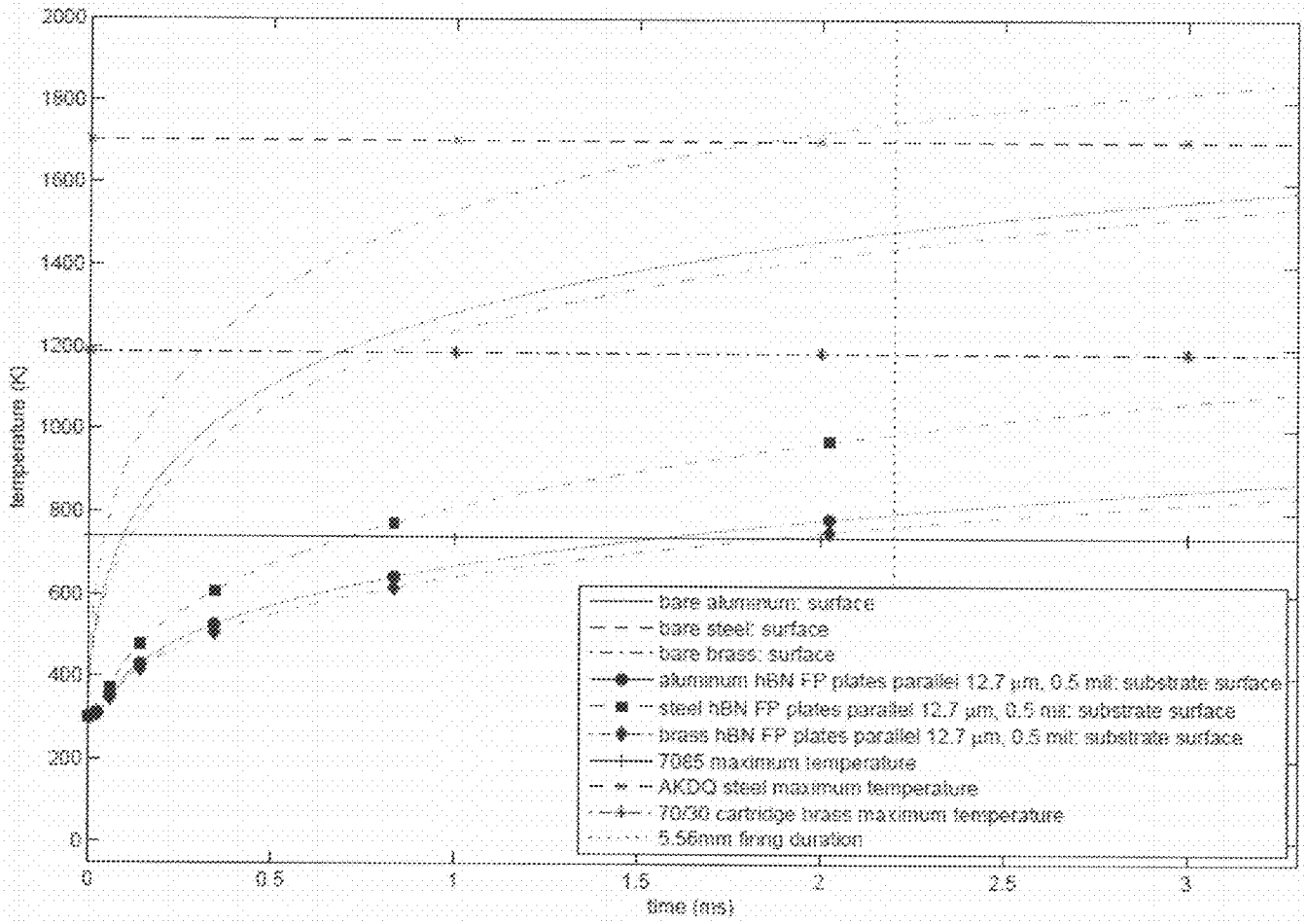
FIG. 4C depicts a thermal model of time vs. temperature for several control substrates compared to various embodiments of the instant disclosure, hBN coated substrates.
Figure 5:
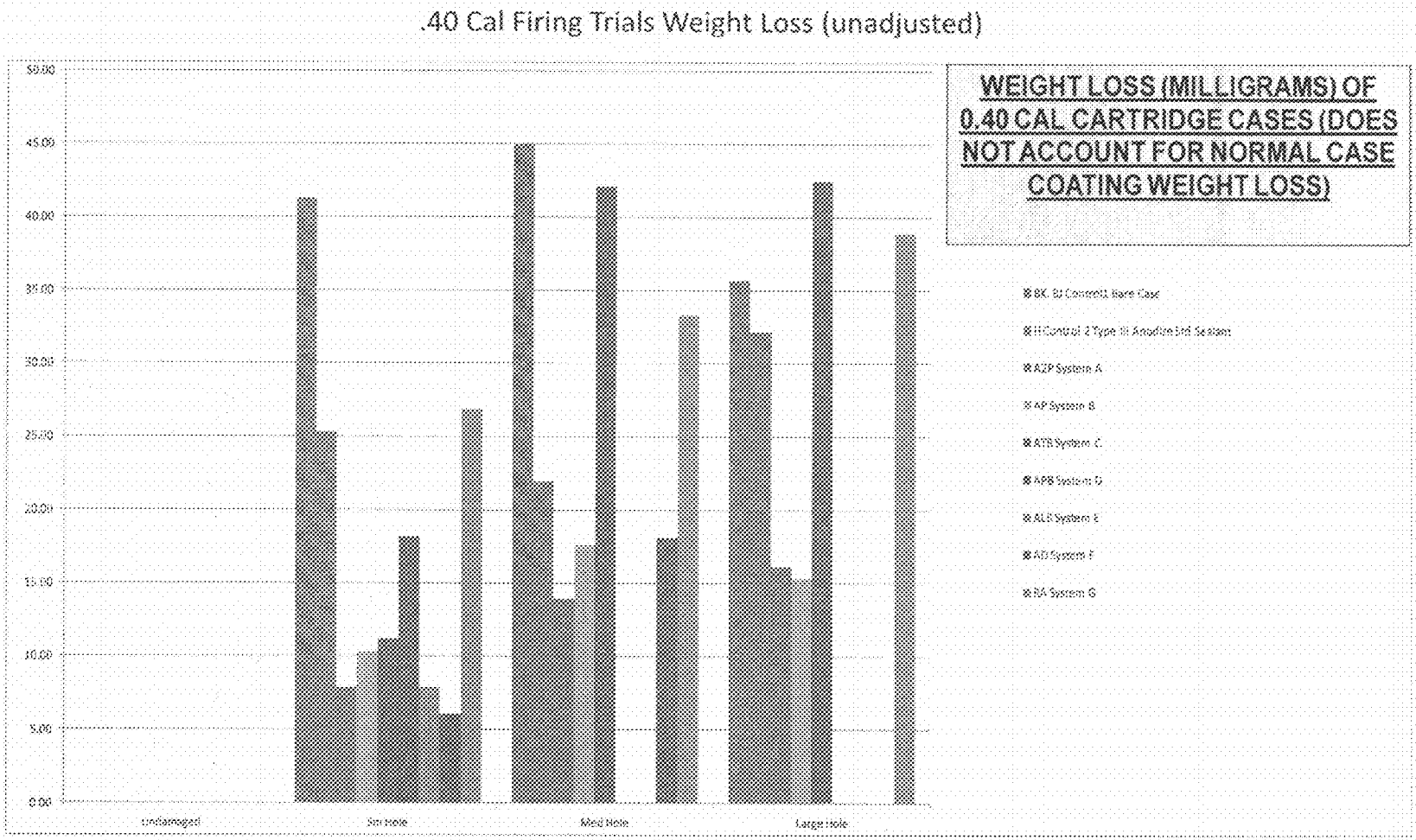
FIG. 5 is a graph of experimental data from Example 1, depicting weight loss of the cases from the .40 Caliber firing trials (unadjusted weight loss) in accordance with various embodiments of the instant disclosure.
Figure 6:
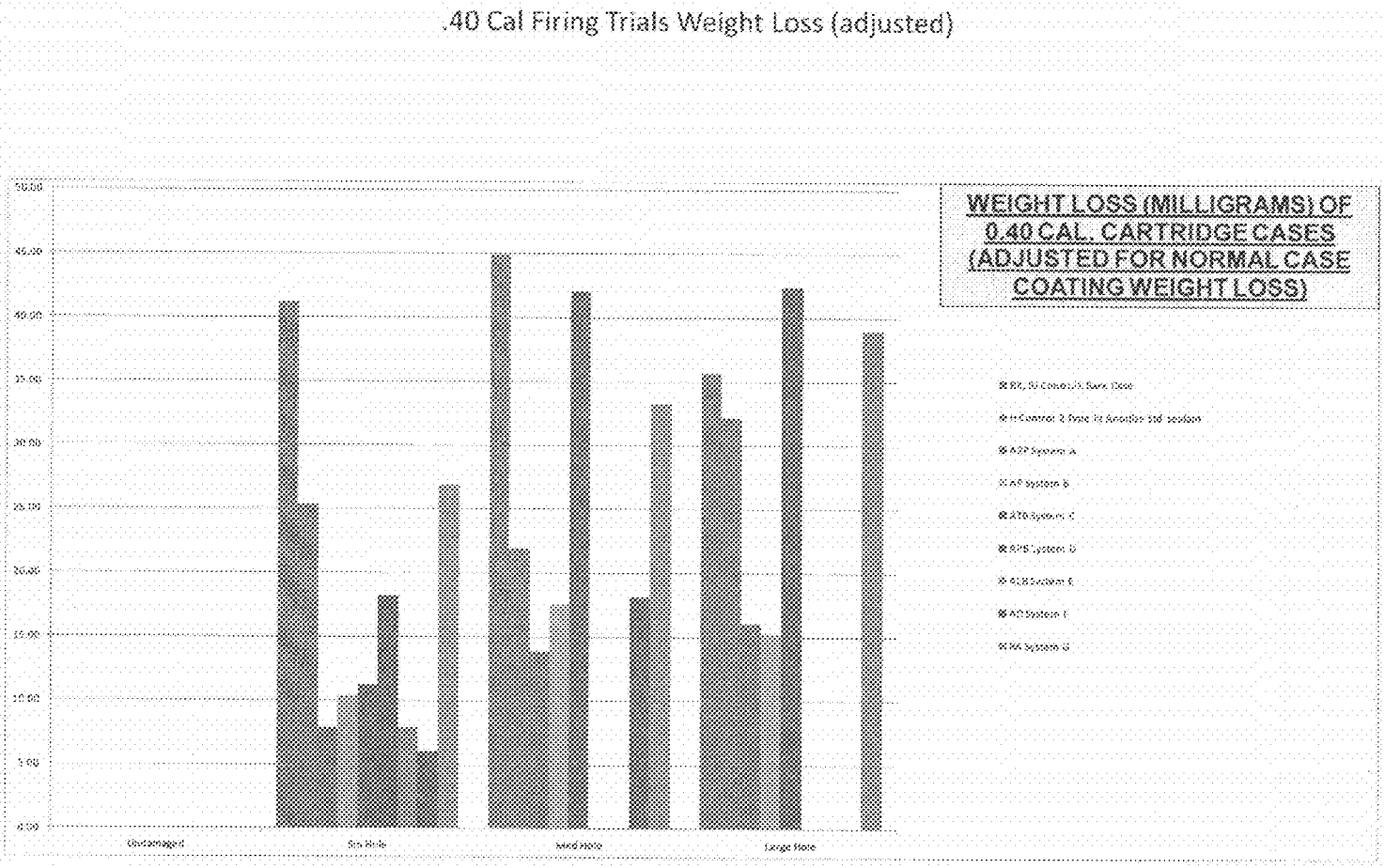
FIG. 6 is a graph of experimental data from Example 1, depicting weight loss of the cases from the .40 Caliber firing trials (adjusted for weight loss) in accordance with various embodiments of the instant disclosure.
Figure 7:
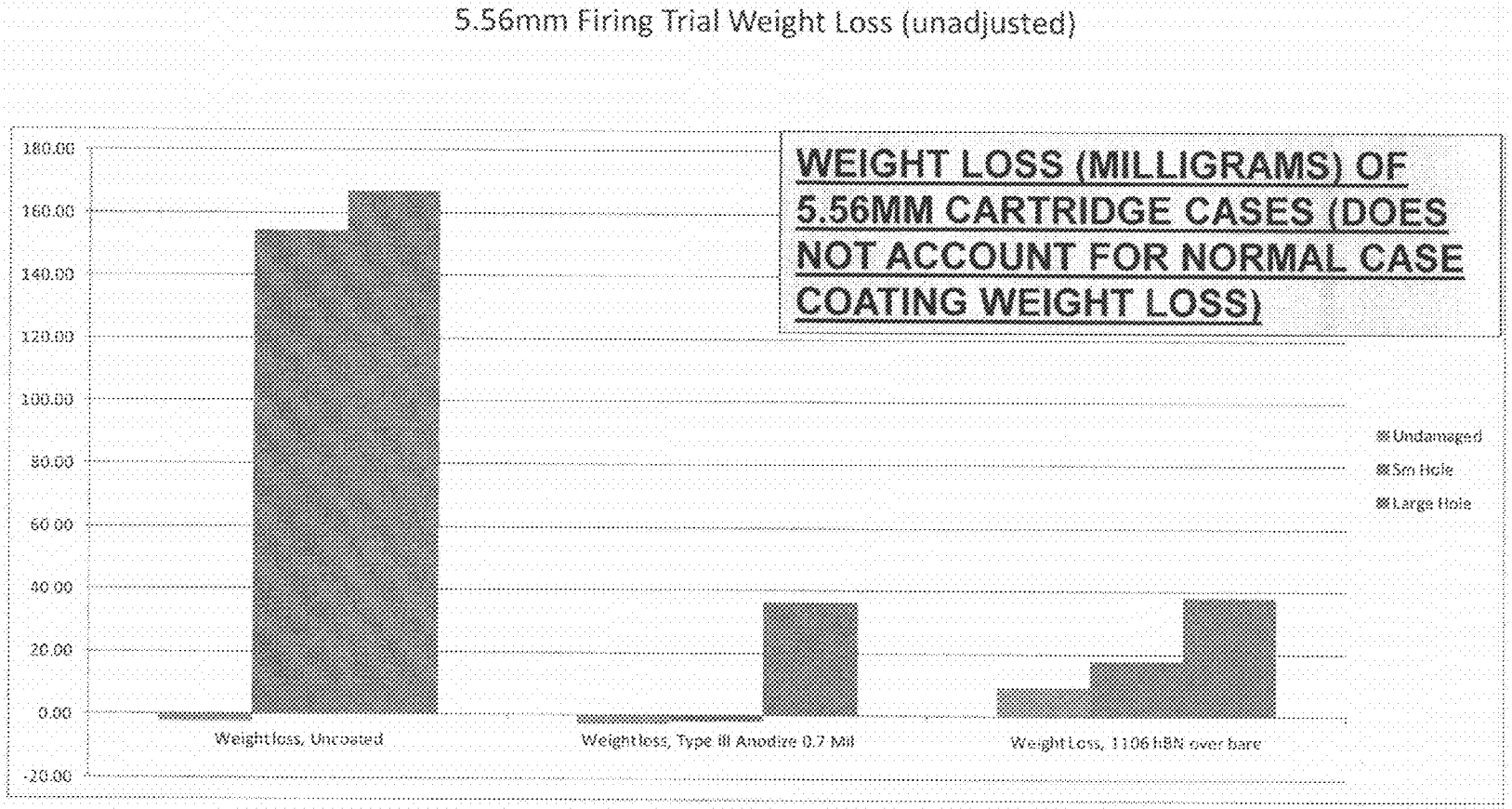
FIG. 7 is a graph of experimental data from Example 2, depicting weight loss of the cases from the 5.56 mm firing trials (unadjusted for weight loss) in accordance with various embodiments of the instant disclosure.
Figure 8:
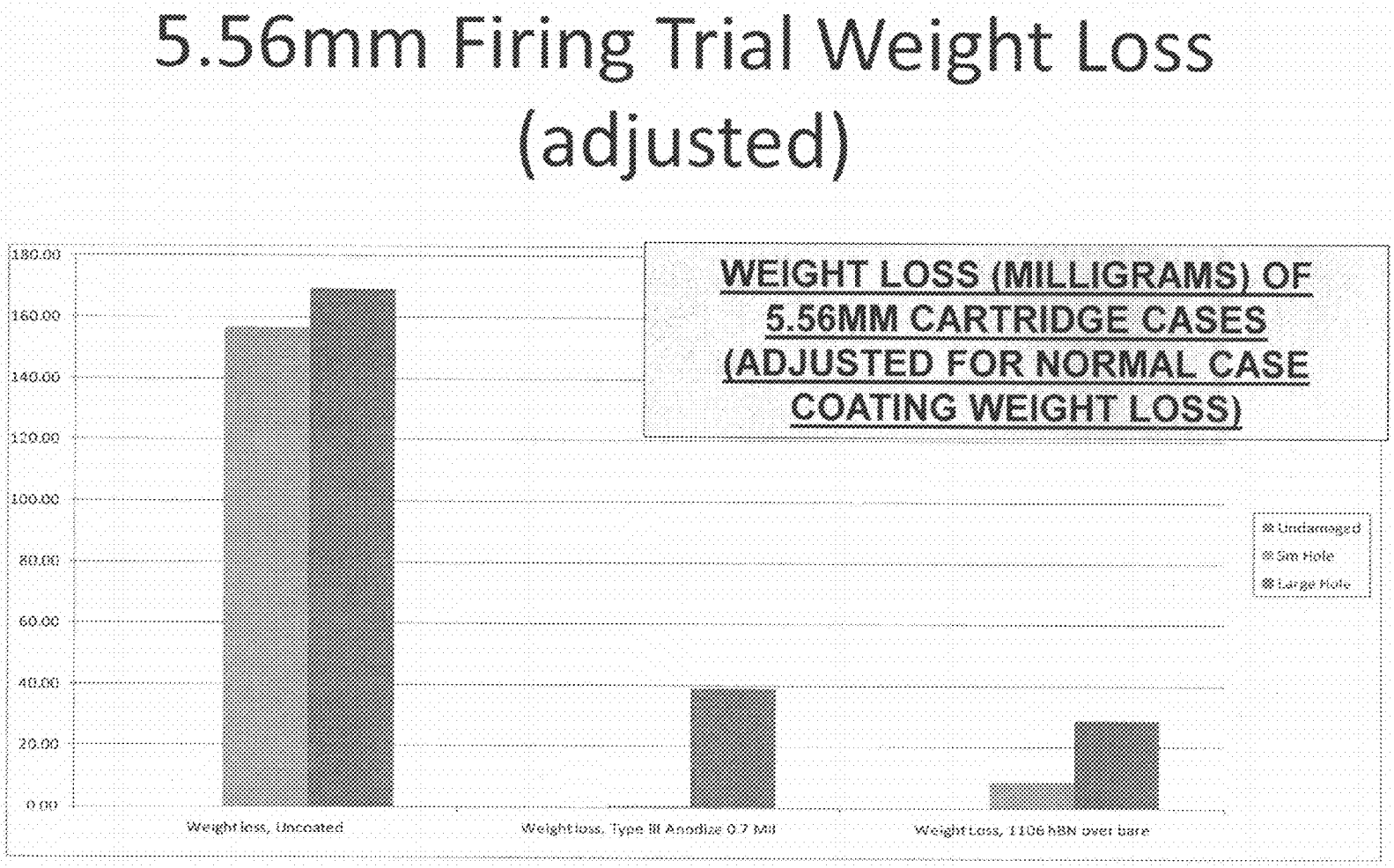
FIG. 8 is a graph of experimental data from Example 2, depicting weight loss of the cases from the 5.56 mm firing trials (adjusted for weight loss) in accordance with various embodiments of the instant disclosure.

Reference will now be made in detail to the accompanying drawings and the experiments performed to support the various embodiments herein, which at least assist in illustrating various pertinent embodiments of the present invention.

Example 1: .40 Caliber Firing Trials

For the .40 Caliber firing trials, undamaged casings and intentionally damaged casings were coated and fired. The intentionally damaged casings were included in the firing trials to confirm what, if any, protective impact the various coating systems would provide casings, in the event of a flaw in the wall of a casing permitting the leakage of propellant gas.

In order to simulate such manufacturing defects, several sizes of round holes were drilled into the sidewalls of cases; a small, medium, or large hole. The cartridges had either: no hole (N)—no damage; a small hole (0.015 inch diameter); a medium hole (0.0625 inch diameter); or a large hole (0.080 inch diameter) in the casing, along with a machine groove in-line with the hole, to facilitate leakage of gases past the case sidewall.

The holes and grooves for the .40 caliber cases were machined into the cartridges prior to coating.

Control 1: Bare Case

For these cases, no surface preparation was completed. The casings were fired as-received.

Control 2: Type III Anodized Cases:

For the Type III anodized cases, the cartridges were anodized in sulfuric acid at 20% by weight, 50° F., with a current density of 36 amperes per square foot (asf) for 40 minutes. Oxide thickness was 0.3 mil. The anodized surface was sealed in Sealing Salt AS (nickel acetate solution)) @200° F. for 10 minutes.

System A: FP Over Type III with Alternate Sealant

The FP was applied to anodized (unsealed) cases that had been placed dry in a vacuum bag until FP was ready to be applied. The firing trial determined that this coating did little to nothing to protect the case from burn through, as compared to the Control-Type III Anodic coating (only).

To apply a Type III anodizing layer to the cases, the cases were anodized in sulfuric acid at 20% by weight, 50° F., 36asf for 40 minutes. Oxide thickness was 0.3 mil. The anodized surface was unsealed with nickel acetate sealant.

A fluropolymer coating (PPG 1HC5697 Durabrite C high gloss clear Fluoropolymer) was applied to over the surface of the Type III anodized case. To apply the coating, the cases were hand-coated twice with an 80/20 (by volume) mixture consisting of fluoropolymer coating and Methyl Isobutylketone (MIBK). The coated case was flashed off for three minutes in between applications and prior to oven cure. The coating was cured for 8 minutes in an electric oven set to 470° F., with a PMT of 454° F. After it was confirmed by visual inspection that the coating had not covered the groove, fluoropolymer coating was applied to the hole and in-line groove with a paint brush and the casing was cured a second time.

System B: FP Over Type III w/ Standard Nickel Acetate Sealant

To apply a Type III anodizing layer to the cases, the cases were anodized in sulfuric acid at 20% by weight, 50° F., 36asf for 40 minutes. Oxide thickness was 0.3 mil. The anodized surface was sealed in Sealing Salt AS (nickel base) @200° F. for 10 minutes.

A fluropolymer coating (PPG 1HC5697 Durabrite C high gloss clear Fluoropolymer) was applied to over the surface of the Type III anodized case. To apply the coating, the cases were hand-coated (dipped) twice with an 80/20 mixture consisting of 80% fluoropolymer coating and 20% methyl isobutylketone (MIBK). The coated case was flashed off for three minutes in between applications and prior to oven cure. The coating was cured for 8 minutes in an electric oven set to 470° F., with a PMT of 459° F. After it was confirmed by visual inspection that the coating had not covered the groove, fluoropolymer coating was applied to the hole and in-line groove with a paint brush and the casing was cured a second time.

System C: Fluropolymer Coating Mixed with Particulate at 35 wt. % (1106 hBN)

To prepare the surface of the aluminum case, the case was cleaned and deoxidized. A cleanser was applied to the casing (A31K Alkaline cleaner) 2.5 minutes at 140° F., followed by a rinse in tap water, then a spray of DI water. To deoxidize the surface, the casing underwent an Anodal® LFN for 2 minutes at room temperature (74°), followed by a tap water rinse and DI water spray.

To a glass jar with glass beads, 19.82 grams of fluoropolymer resin (65% by weight) and 6.94 grams of boron nitride solids (35% by weight) (hBN, PUHP 1106, Saint Gobain) were added. The jar with beads, fluoropolymer and hBN was inserted onto a paint shaker, which was operated for one hour in order to disperse the hBN powder into the fluropolymer coating. Once the mixing was completed, the mixture was further reduced with solvent (MIBK) for coating application.

To apply the fluoropolymer coating, a mixture was prepared consisting of (by volume) of 45 mL fluoropolymer coating (PPG 1HC5697 Lot#19474 Durabrite C high gloss clear fluoropolymer) and 20 mL methyl isobutylketone (MIBK). Then, the casing was hand-dipped and cured. To cure the coating, the coated cases were heated in an electric oven set to 460° F. for a period of 2.5 minutes, with a PMT range from 425° F. to 430° F. Upon visual observation, no issues were noticed during application of the coatings.

System D: Fluropolymer Coating with Particulate 1 (hBN=PUHP 500) Over Bare Case

To prepare the surface of the aluminum case, the case was cleaned and deoxidized. A cleanser was applied to the casing (A31K Alkaline cleaner) 2.5 minutes at 140° F., followed by a rinse in tap water, then a spray of DI water. To deoxidize the surface, the casing underwent an Anodal® LFN for 2 minutes at room temperature (74°), followed by a tap water rinse and DI water spray.

To a glass jar with glass beads, 19.82 grams of fluoropolymer resin and 6.94 grams of boron nitride solids (hBN, PUHP 500, Saint Gobain) were added. The jar with beads, fluoropolymer and hBN was inserted onto a paint shaker, which was operated for one hour in order to disperse the hBN powder into the fluropolymer coating. Once the mixing was completed, the mixture was further reduced with solvent (MIBK) for coating application.

To apply the fluoropolymer/hBN coating, a mixture (by volume) of 45/20 mLs of fluoropolymer coating (PPG 1HC5697 Lot#19474 Durabrite C high gloss clear Fluoropolymer having hBN therein) to methyl isobutylketone (MIBK) was prepared. Then, the casing was hand-dipped and cured. To cure the coating, the coated cases were heated in an electric oven set to 460° F. for a period of 2.5 minutes, with a PMT range from 425° F. to 430° F. Upon visual observation, no issues were noticed during application of the coatings.

System E: Fluropolymer Coating with Particulate 2 (hBN=LEAU 500) Over Bare Case

To prepare the surface of the aluminum case, the case was cleaned and deoxidized. A cleanser was applied to the casing (A31K Alkaline cleaner) 2.5 minutes at 140° F., followed by a rinse in tap water, then a spray of DI water. To deoxidize the surface, the casing underwent an Anodal® LFN for 2 minutes at room temperature (74°), followed by a tap water rinse and DI water spray.

Measured out 19.82 grams of fluoropolymer resin and 6.94 grams of boron nitride solids (hBN, LEAU 500, Saint Gobain) and placed in a glass jar with glass beads. The jar with beads, fluoropolymer and hBN was inserted onto a paint shaker, which was operated for one hour in order to disperse the hBN powder into the fluropolymer coating. Once the mixing was completed, the mixture was further reduced with solvent (MIBK) for coating application.

To apply the fluoropolymer/hBN coating, a mixture (by volume) of 45/20 mLs of fluoropolymer coating (PPG 1HC5697 Lot#19474 Durabrite C high gloss clear Fluoropolymer having hBN therein) to methyl isobutylketone (MIBK) was prepared. Then, the casing was hand-dipped and cured. To cure the coating, the coated cases were heated in an electric oven set to 460° F. for a period of 2.5 minutes, with a PMT range from 425° F. to 430° F. Upon visual observation, no issues were noticed during application of the coatings.

System F: Silicone Coating Over Type III with Standard Sealant

To apply a Type III anodizing layer to the cases, the cases were anodized in sulfuric acid at 20% by weight, 50° F., 36asf for 40 minutes. Oxide thickness was 0.3 mil. The anodized surface was sealed in Sealing Salt AS (nickel base) @200° F. for 10 minutes.

A silicone coating (Dow Corning 1-2577 clear RTV) was applied over the surface of the Type III anodized case. To apply the coating, the cases were hand-coated (dipped) twice with an 1/1 mixture consisting of silicone coating (Dow Corning 1-2577 clear RTV)/Methyl Ethyl Ketone (MEK) and flashed off for three minutes in between applications and prior to oven cure. To cure the coating, the coated cartridges were cured for 10 minutes in an electric oven set at 180° F.

It was observed that the silicone coatings (even reduced with solvent) would not conform over the hole and the in-line groove with the dip method. (Hand-dipping a cartridge into the as-received coating (undiluted with solvent) yielded the same result). A paint brush was utilized to apply the coating over the hole and in-line groove.

System G: Anodic Oxide Coating Over Bare Case (Magnamax-HT FT1)

This coating was applied by General Magnaplate (Linden, N.J.).

System K: Fluropolymer Coating with Particulate 0 at 45 wt. % (hBN PUHP1106)

System K is similar to System C (.40 caliber system), but utilizes a larger wt. % of ceramic particulate than System C (45 wt. % vs. 35 wt. %).

For each shot completed in the firing trials, each case was visually inspected to observe the coating and uniformity of the coating. After firing, each case was visually observed for burn through. Weight loss was calculated, where weight loss can be a factor in identifying a burn through event. However, where the coating is sacrificial, weight loss is expected as the coating and/or coating constituents come off during the firing event. For each shot, metrics were collected on the firing event to confirm that the fired shot was a good shot/true shot. The firing event data collected for each shot included: (a) peak pressure; (b) time to peak pressure; and (c) velocity of shot. In some instances, firing trials having bad transducer readings were confirmed to be good shots by the shot velocity measurement. All shots in both the .40 Caliber firing trials resulted in good shots.

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| Control 1 Bare Case FT1 | 1 | N | 1490.8 | 1490.8 | 0 | −0.13 | 0.02 | |
| Control 1 Bare Case FT1 | 2 | N | 1486.4 | 1485.9 | 0.5 | | | |
| Control 1 Bare Case FT1 | 3 | N | 1479.1 | 1480 | −0.9 | | | |
| Control 1 Bare Case FT2 | 4 | N | 1492.50 | 1492.00 | 0.5 | 0.17 | | |
| Control 1 Bare Case FT2 | 5 | N | 1489.80 | 1490.00 | −0.2 | | | |
| Control 1 Bare Case FT2 | 6 | N | 1489.20 | 1489.00 | 0.2 | | | |
| Control 2 Type III Anodize w/Std. Sealant FT1 | 1 | N | 1485.6 | 1487 | −1.4 | −1.43 | −1.43 | |
| Control 2 Type III Anodize w/Std. Sealant FT1 | 2 | N | 1495 | 1496.3 | −1.3 | | | |
| Control 2 Type III Anodize w/Std. Sealant FT1 | 3 | N | 1474.9 | 1476.5 | −1.6 | | | |
| System A: FP Coating/Clear over Type III w/ Alternate Sealant FT1 | 1 | N | 1523.1 | 1518 | 5.1 | 5.80 | 5.80 | |
| System A: FP Coating/Clear over Type III w/ Alternate Sealant FT1 | 2 | N | 1527.1 | 1520.5 | 6.6 | | | |
| System A: FP Coating/Clear over Type III w/ Alternate Sealant FT1 | 3 | N | 1510.3 | 1504.6 | 5.7 | | | |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| System B: FP Coating/Clear over Type III w/ Std. Sealant FT1 | 1 | N | 1515.5 | 1513.6 | 1.9 | 2.60 | 2.60 | |
| System B: FP Coating/Clear over Type III w/ Std. Sealant FT1 | 2 | N | 1511.8 | 1510 | 1.8 | | | |
| System B: FP Coating/Clear over Type III w/ Std. Sealant FT1 | 3 | N | 1509.7 | 1505.6 | 4.1 | | | |
| System C: FP Coating + Particulate 0 over Bare Case (FT2) | 1 | N | 1521.20 | 1514.00 | 7.2 | 7.67 | 7.67 | |
| System C: FP Coating + Particulate 0 over Bare Case (FT2) | 2 | N | 1525.50 | 1518.00 | 7.5 | | | |
| System C: FP Coating + Particulate 0 over Bare Case (FT2) | 3 | N | 1521.30 | 1513.00 | 8.3 | | | |
| System D: FP Coating + Particulate1 over Bare Case FT2 | 1 | N | 1507.30 | 1499.00 | 8.3 | 8.30 | 8.30 | Particulate1 = hBN (PUHP500) |
| System D: FP Coating + Particulate1 over Bare Case FT2 | 2 | N | 1527.00 | 1519.00 | 8 | | | Particulate1 = hBN (PUHP500) |
| System D: FP Coating + Particulate1 over Bare Case FT2 | 3 | N | 1529.60 | 1521.00 | 8.6 | | | Particulate1 = hBN (PUHP500) |
| System E: FP Coating + Particulate2 over Bare Case FT2 | 1 | N | 1523.90 | 1516.00 | 7.9 | 8.10 | 8.10 | Particulate2 - hBN (LEAU500) |
| System E: FP Coating + Particulate2 over Bare Case FT2 | 2 | N | 1523.60 | 1515.00 | 8.6 | | | Particulate2 - hBN (LEAU500) |
| System E: FP Coating + Particulate2 over Bare Case FT2 | 3 | N | 1528.80 | 1521.00 | 7.8 | | | Particulate 2 - hBN (LEAU500) |
| System F: Silicone Coating over Type III Anodize w/Std. Sealant FT1 | 1 | N | 1534.5 | 1500.9 | 33.6 | 32.00 | 32 | Coating flaked off from the outside of the case during assembly; also observed flaking during insertion into the chamber. All silicone cases left waxy deposit in chamber and barrel of gun, near total expulsion of internal coating after firing event. NOTES: Silicone = DOW 2577 |
| System F: Silicone Coating over Type III Anodize w/Std. Sealant FT1 | 2 | N | 1549.8 | 1509.4 | 40.4 | | | |
| System F: Silicone Coating over Type III Anodize w/Std. Sealant FT1 | 3 | N | 1539 | 1517 | 22 | | | Bad pressure reading attributed to transducer, velocity normal, thus normal firing event. |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| System G: General Magnaplate oxide coating FT1 | 1 | N | 1633.1 | 1629.7 | 3.4 | 3.53 | 3.53 | Coating flaked off, generally performed same as uncoated bare case, compared via weight loss and visual observation looking for indicators of a burn through event. |
| System G: General Magnaplate oxide coating FT1 | 2 | N | 1650.2 | 1646.1 | 4.1 | | | |
| System G: General Magnaplate oxide coating FT1 | 3 | N | 1632.9 | 1629.8 | 3.1 | | | |
| Bare Case (Control 1) FT1 | 1 | S | 1488.3 | 1462.7 | 25.6 | 27.20 | 41.30 | |
| Bare Case (Control 1) FT1 | 2 | S | 1488.5 | 1453.9 | 34.6 | | | |
| Bare Case (Control 1) FT1 | 3 | S | 1474 | 1452.6 | 21.4 | | | |
| Bare Case (Control 1) FT2 | 4 | S | 1486.90 | 1418.00 | 68.9 | 55.40 | | |
| Bare Case (Control 1) FT2 | 5 | S | 1494.80 | 1449.00 | 45.8 | | | |
| Bare Case (Control 1) FT2 | 6 | S | 1482.50 | 1431.00 | 51.5 | | | |
| Type III Anodize w/Std. Sealant (Control 2) FT1 | 1 | S | 1478.2 | 1448.9 | 29.3 | 23.87 | 23.87 | |
| Type III Anodize w/Std. Sealant (Control 2) FT1 | 2 | S | 1489.3 | 1466.1 | 23.2 | | | |
| Type III Anodize w/Std. Sealant (Control 2) FT1 | 3 | S | 1482.9 | 1463.8 | 19.1 | | | Normal firing event, a bad transducer resulted in a low pressure reading. Velocity measurement was normal for a true firing event. |
| System A: FP Coating/Clear over Type III w/ Alternate Sealant FT1 | 1 | S | 1519.6 | 1508 | 11.6 | 13.70 | 13.70 | |
| System A: FP Coating/Clear over Type III w/ Alternate Sealant FT1 | 2 | S | 1509.1 | 1494 | 15.1 | | | |
| System A: FP Coating/Clear over Type III w/ Alternate Sealant FT1 | 3 | S | 1507 | 1492.6 | 14.4 | | | |
| System B: FP Coating/Clear over Type III w/ Std. Sealant FT1 | 1 | S | 1516.1 | 1501.7 | 14.4 | 12.93 | 12.93 | |
| System B: FP Coating/Clear over Type III w/ Std. Sealant FT1 | 2 | S | 1515.4 | 1504.4 | 11 | | | |
| System B: FP Coating/Clear over Type III w/ Std. Sealant FT1 | 3 | S | 1515.8 | 1502.4 | 13.4 | | | |
| System C: FP Coating + Particulate 0 over Bare Case (FT2) | 1 | S | 1518.50 | 1505.00 | 13.5 | 18.90 | 18.90 | Some bubbling was observed in internal coating at case mouth; it was smoothed with sandpaper before weigh. |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| System C: FP Coating + Particulate 0 over Bare Case (FT2) | 2 | S | 1513.80 | 1498.00 | 15.8 | | | Though visual observation coverage was confirmed so internal coating only at case mouth; no coverage visually observed ⅜ inch and greater from mouth |
| System C: FP Coating + Particulate 0 over Bare Case (FT2) | 3 | S | 1510.40 | 1483.00 | 27.4 | | | Elongated bubble visually observed in the vent groove at the hole; internal coating bubbles visually observed at the head end. Smoothed before weigh. |
| System D: FP Coating + Particulate1 over Bare Case FT2 | 1 | S | 1521.10 | 1500.00 | 21.1 | 26.47 | 26.47 | |
| System D: FP Coating + Particulate1 over Bare Case FT2 | 2 | S | 1518.00 | 1486.00 | 32 | | | |
| System D: FP Coating + Particulate1 over Bare Case FT2 | 3 | S | 1524.30 | 1498.00 | 26.3 | | | |
| System E: FP Coating + Particulate2 over Bare Case FT2 | 1 | S | 1511.40 | 1498.00 | 13.4 | 16.03 | 16.03 | Slight bubble visually observed in vent groove over hole, Coverage visually observed in internal coating only at case mouth, with no coverage ⅜ inch and greater from mouth |
| System E: FP Coating + Particulate2 over Bare Case FT2 | 2 | S | 1510.20 | 1494.00 | 16.2 | | | Coverage visually observed in internal coating only at case mouth, with no coverage ⅜ inch and greater from mouth |
| System E: FP Coating + Particulate2 over Bare Case FT2 | 3 | S | 1516.50 | 1498.00 | 18.5 | | | Slight bubble visually observed in vent groove over hole, Coverage visually observed in internal coating only at case mouth, with no coverage ⅜ inch and greater from mouth |
| System G: General Magnaplate oxide coating FT1 | 1 | S | 1623.4 | 1592.9 | 30.5 | 30.40 | 30.40 | |
| System G: General Magnaplate oxide coating FT1 | 2 | S | 1622 | 1590.6 | 31.4 | | | |
| System G: General Magnaplate oxide coating FT1 | 3 | S | 1629 | 1599.7 | 29.3 | | | |
| Bare Case (Control 1) FT1 | 1 | M | 1470.6 | 1444.1 | 26.5 | 34.83 | 44.95 | |
| Bare Case (Control 1) FT1 | 2 | M | 1478.6 | 1442 | 36.6 | | | |
| Bare Case (Control 1) FT1 | 3 | M | 1478.4 | 1437 | 41.4 | | | |
| Bare Case (Control 1) FT2 | 4 | M | 1492.20 | 1426.00 | 66.2 | 55.07 | | |
| Bare Case (Control 1) FT2 | 5 | M | 1476.90 | 1419.00 | 57.9 | | | |
| Bare Case (Control 1) FT2 | 6 | M | 1482.10 | 1441.00 | 41.1 | | | |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| Type III Anodize w/Std. Sealant (Control 2) FT1 | 1 | M | 1484.4 | 1462.2 | 22.2 | 20.47 | 20.47 | |
| Type III Anodize w/Std. Sealant (Control 2) FT1 | 2 | M | 1485 | 1464.7 | 20.3 | | | |
| Type III Anodize w/Std. Sealant (Control 2) FT1 | 3 | M | 1489.3 | 1470.4 | 18.9 | | | |
| System A: FP Coating/Clear over Type III w/ Alternate Sealant FT1 | 1 | M | 1514.1 | 1493.5 | 20.6 | 19.70 | 19.70 | |
| System A: FP Coating/Clear over Type III w/ Alternate Sealant FT1 | 2 | M | 1513.4 | 1489.9 | 23.5 | | | Visual observation of unfired coated cartridge case: case appeared to have little coating around ejector groove. After firing, damage to cartridge case was the greatest of three firing trials for this coating/hole size combination. |
| System A: FP Coating/Clear over Type III w/ Alternate Sealant FT1 | 3 | M | 1520.5 | 1505.5 | 15 | | | |
| System B: FP Coating/Clear over Type III w/ Std. Sealant FT1 | 1 | M | 1505.5 | 1487.3 | 18.2 | 20.17 | 20.17 | |
| System B: FP Coating/Clear over Type III w/ Std. Sealant FT1 | 2 | M | 1514.7 | 1491 | 23.7 | | | |
| System B: FP Coating/Clear over Type III w/ Std. Sealant FT1 | 3 | M | 1515.6 | 1497 | 18.6 | | | |
| System C: FP Coating + Particulate 0 over Bars Case (FT2) | 1 | M | 1522.00 | 1476.00 | 46 | 42.13 | 42.13 | Bubble visually observed in vent groove at hole, opened at inspection prior to weighing. |
| System C: FP Coating + Particulate 0 over Bars Case (FT2) | 2 | M | 1522.20 | 1479.00 | 43.2 | | | Slight bubble visually observed in vent groove at hole |
| System C: FP Coating + Particulate 0 over Bars Case (FT2) | 3 | M | 1522.20 | 1485.00 | 37.2 | | | Slight bubble visually observed in vent groove at hole |
| System F: Silicone Coating over Type III Anodize w/Std. Sealant FT1 | 1 | M | 1550.2 | 1497 | 53.2 | 50.13 | 50.13 | |
| System F: Silicone Coating over Type III Anodize w/Std. Sealant FT1 | 2 | M | 1557.7 | 1512 | 45.7 | | | Bad pressure reading attributed to transducer, velocity "normal" thus this is a true firing event. |
| System F: Silicone Coating over Type III Anodize w/Std. Sealant FT1 | 3 | M | 1542.5 | 1491 | 51.5 | | | |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| System G: General Magnaplate oxide coating FT1 | 1 | M | 1634.9 | 1591.6 | 43.3 | 36.80 | 36.80 | Damage noticeable through visual observation. Via visual observation, very little difference in damage to these casings vs. bare uncoated cases. |
| System G: General Magnaplate oxide coating FT1 | 2 | M | 1626.8 | 1593.4 | 33.4 | | | |
| System G: General Magnaplate oxide coating FT1 | 3 | M | 1643.4 | 1609.7 | 33.7 | | | |
| Bare Case (Control 1) FT1 | 1 | L | 1481 | 1449 | 32 | 27.93 | 35.70 | |
| Bare Case (Control 1) FT1 | 2 | L | 1481.4 | 1454.5 | 26.9 | | | |
| Bare Case (Control 1) FT1 | 3 | L | 1468.9 | 1444 | 24.9 | | | |
| Bare Case (Control 1) FT2 | 4 | L | 1481.80 | 1428.00 | 53.8 | 43.47 | | |
| Bare Case (Control 1) FT2 | 5 | L | 1480.70 | 1442.00 | 38.7 | | | |
| Bare Case (Control 1) FT2 | 6 | L | 1476.90 | 1439.00 | 37.9 | | | |
| Type III Anodize w/Std. Sealant (Control 2) FT1 | 1 | L | 1468.6 | 1425.6 | 43 | 30.77 | 30.77 | |
| Type III Anodize w/Std. Sealant (Control 2) FT1 | 2 | L | 1472.9 | 1444.3 | 28.6 | | | |
| Type III Anodize w/Std. Sealant (Control 2) FT1 | 3 | L | 1480.4 | 1459.7 | 20.7 | | | |
| System A: FP Coating/Clear over Type III w/ Alternate Sealant FT1 | 1 | L | 1483.4 | 1472.2 | 11.2 | 21.90 | 21.90 | |
| System A: FP Coating/Clear over Type III w/ Alternate Sealant FT1 | 2 | L | 1485.5 | 1459.1 | 26.4 | | | |
| System A: FP Coating/Clear over Type III w/ Alternate Sealant FT1 | 3 | L | 1483.7 | 1455.6 | 28.1 | | | |
| System B: FP Coating/Clear over Type III w/ Std. Sealant FT1 | 1 | L | 1490.3 | 1468 | 22.3 | 17.93 | 17.93 | |
| System B: FP Coating/Clear over Type III w/ Std. Sealant FT1 | 2 | L | 1497.2 | 1480.4 | 16.8 | | | |
| System B: FP Coating/Clear over Type III w/ Std. Sealant FT1 | 3 | L | 1495.4 | 1480.7 | 14.7 | | | |
| System C: FP Coating + Particulate 0 over Bare Case (FT2) | 1 | L | 1505.80 | 1454.00 | 51.8 | 50.13 | 50.13 | Internal coating pillowed near mouth of case, smoothed with sandpaper prior to weighing. |
| System C: FP Coating + Particulate 0 over Bare Case (FT2) | 2 | L | 1512.30 | 1461.00 | 51.3 | | | Internal coating near mouth of case had a slight ridge, smoothed with sandpaper before weighing. |

-continued

Table of Weight Losses for .40 Caliber Firing Trials (Trial #1 and Trial #2)

| Coating | # in group | Hole | Weight before (mg) | Weight after (mg) | Weight loss (mg) | Avg within subgroup | Avg within group | Notes/Observations |
|---|---|---|---|---|---|---|---|---|
| System C: FP Coating + Particulate 0 over Bare Case (FT2) | 3 | L | 1515.30 | 1468.00 | 47.3 | | | |
| System F: Silicone Coating over Type III Anodize w/Std. Sealant FT1 | 1 | L | 1499.7 | 1479.7 | 20 | 24.87 | 24.87 | |
| System F: Silicone Coating over Type III Anodize w/Std. Sealant FT1 | 2 | L | 1502.3 | 1468 | 34.3 | | | |
| System F: Silicone Coating over Type III Anodize w/Std. Sealant FT1 | 3 | L | 1488 | 1467.7 | 20.3 | | | |
| System G: General Magnaplate oxide coating FT1 | 1 | L | 1630.2 | 1583.2 | 47 | 42.50 | 42.50 | Very little difference observed in these casings vs. bare uncoated cases. |
| System G: General Magnaplate oxide coating FT1 | 2 | L | 1630.2 | 1584.1 | 46.1 | | | |
| System G: General Magnaplate oxide coating FT1 | 3 | L | 1625.6 | 1591.2 | 34.4 | | | |

The following observations were made in view of the data obtained from the firing trails. It was observed that plain fluoropolymer coating over bare aluminum was an improvement over bare aluminum casing (control 1).

It was observed that, during firing trials, the silicone coating became detached from the case interiors when fired and was deposited by the propellant gases onto the barrel of the firearm. This result was deemed unacceptable from a practical (barrel fouling) standpoint and not pursued further. There was no observable burn through even in the large hole, "damaged" cases, but the barrel of the .40 caliber gun was clogged. It is possible, with tweaking of the formulation or application technique, that a silicone coating could be utilized, given the success of the coating in reducing, preventing, and/or eliminating burn-through.

In addition to completing weight loss calculations (to understand whether and to what extent burn through may have occurred), visual observations were also completed. Without being bound by a particular mechanism or theory, weight loss could be attributed to the coating burning off, where loss of the coating could result in protection of the underlying substrate during a firing event (e.g. in the case of a "sacrificial coating").

Thus, the effectiveness of the coating at protecting the aluminum substrate can be observed in images of the case after the firing event occurred. A large amount of material loss is observable when melting occurs during the firing of the ammunition. When the coating is effective discoloration occurs, but the hole is still near its original dimension and shape and the case can be seen to be intact.

In order to approximate a standardized evaluation of whether and to what extent a "burn through" event occurred in fired cases, a team of seven individuals was assembled. The team included three individuals with backgrounds in coating chemistry, three individuals with engineering backgrounds, and two metallurgists. Each individual visually observed the fired cases and ranked the cases in an order of "best" to "worst" appearance. Subsequently, each of the coating systems assigned a letter grade, which averaged the letter grades of the team members regarding visually observed level/extent of "burn through" events. The letter grades for each of the coating systems is set out below for the two controls and for four coating systems. A letter grade of A denotes little to no burn-through, while a letter grade of C denotes a large amount of/evident burn-through, as evaluated via visual observation. A letter grade of B denotes some burn-through, though less compared to a letter grade of "C" and more as compared to a letter grade of "A".

| Code | Label | Small Hole | Medium Hole | Large Hole | Overall Hole Grade |
|---|---|---|---|---|---|
| B | Bare case (Control 1) | C | C | C | C |
| H | Type III Hard Anodized (Control 2) | C+ | C+ | C+ | C+ |
| RA | General Magnaplate | C | C | C | C |
| AD | Silicone over Type III with Std. Sealant | B | A | B | B |
| AP | Fluoropolymer over Type III anodize | A | A | A | A |
| A2P | FP over Type III Anodized (with alternate sealing method, i.e. sealant is fluoropolymer) | A | A | A | A |

Example 2: 5.56 mm Firing Trials AA7085

The same preps for this trial for the various controls and coating systems were the same as set out above, with the exception that the fluoropolymer with particulate 0 included the particulate at 45 wt %).

Control 1: Bare Case

For these cases, no surface preparation was completed. The casings were fired as-received.

Control 2: Type III Anodized Cases:

For the Type III anodized cases, the cartridges were anodized in sulfuric acid at 20% by weight, 50° F., 36asf for 40 minutes. Oxide thickness was 0.7 mil. The anodized surface was sealed in nickel acetate sealing salt AS@200° F. for 10 minutes.

System K:

To prepare the surface of the aluminum case, the case was cleaned and deoxidized. A cleanser was applied to the casing (A31K Alkaline cleaner) 2.5 minutes at 140° F., followed by a rinse in tap water, then a spray of DI water. To deoxidize the surface, the casing underwent an Anodal® LFN for 2 minutes at room temperature (74°), followed by a tap water rinse and DI water spray.

To a glass jar with glass beads, 19.82 grams of fluoropolymer resin and 8.92 grams of boron nitride solids (hBN, PUHP 1106, Saint Gobain) were added. The jar with beads, fluoropolymer and hBN was inserted onto a paint shaker, which was operated for one hour in order to disperse the hBN powder into the fluropolymer coating. Once the mixing was completed, the mixture was further reduced with solvent (MIBK) for coating application.

To apply the fluoropolymer coating, a mixture was prepared consisting of (by volume) of 45 mL fluoropolymer coating (PPG 1HC5697 Lot#19474 Durabrite C high gloss clear Fluoropolymer) and 20 mL methyl isobutylketone (MIBK). Then, the casing was hand-dipped and cured. To cure the coating, the coated cases were heated in an electric oven set to 460° F. for a period of 2.5 minutes, with a PMT range from 425° F. to 430° F. Upon visual observation, no issues were noticed during application of the coatings.

For the 5.56 mm firing trials, undamaged casings and intentionally damaged casings were coated and fired. The intentionally damaged casings were included in the firing trials to confirm what, if any, protective impact the various coating systems would provide casings, in the event of a small, medium, or large hole in the casing (attributed to a manufacturing defect). The cartridges had no hole (N)—no damage; a small hole (0.025 inch diameter); or a large hole (0.063 inch diameter) in the casing, along with a machine groove in-line with the hole.

For each shot completed in the firing trials, each case was visually inspected to observe the coating and uniformity of the coating. After firing, each case was visually observed for burn through. Weight loss was calculated, where weight loss can be a factor in identifying a burn through event. However, where the coating is sacrificial, weight loss is expected as the coating and/or coating constituents come off during the firing event. For each shot, metrics were collected on the firing event to confirm that the fired shot was a good shot/true shot. The firing event data collected for each shot included: (a) peak pressure; (b) time to peak pressure; and (c) velocity of shot. In some instances, firing trials having bad transducer readings were confirmed to be good shots by the shot velocity measurement. All shots in both the .40 Caliber firing trials and the 5.56 firing trial resulted in good shots.

Table of Weight Losses for 5.56 mm Firing Trials

| Coating | # in group | Hole | Weight before (mg) | Weight after (mg) | Weight loss (mg) | Avg within group | Weight loss (-baseline) | Notes and Visual Observations |
|---|---|---|---|---|---|---|---|---|
| Control 2: Type III Anodized w/Std. Sealant | 1 | N | 2461.2 | 2464.3 | −3.1 | −2.8 | NA | Baseline - Fired all as second series in the trial - all normal |
| Control 2: Type III Anodized w/Std. Sealant | 2 | N | 2460.8 | 2463.3 | −2.5 | | | Baseline - Fired all as second series in the trial - all normal |
| Control 2: Type III Anodized w/Std. Sealant | 3 | N | 2466.8 | 2469.7 | −2.9 | | | Baseline - Fired all as second series in the trial - all normal |
| Control 1: Bare Case | 1 | N | 2458.9 | 2461.0 | −2.1 | −2.3 | NA | Baseline - Fired all as first series in the trial - all normal, new barrel |
| Control 1: Bare Case | 2 | N | 2442.1 | 2444.7 | −2.6 | | | Baseline - Fired all as first series in the trial - all normal, new barrel |
| Control 1: Bare Case | 3 | N | 2444.6 | 2446.8 | −2.2 | | | Baseline - Fired all as first series in the trial - all normal, new barrel |

-continued

Table of Weight Losses for 5.56 mm Firing Trials

| Coating | # in group | Hole | Weight before (mg) | Weight after (mg) | Weight loss (mg) | Avg within group | Weight loss (-baseline) | Notes and Visual Observations |
|---|---|---|---|---|---|---|---|---|
| System K: FP + Particulate 0 over Bare Case | 1 | N | 2520.7 | 2503.5 | 17.2 | 9.1 | NA | (Particulate 0 = hBN (1106); Investigated fired weights and left as is - normal case no burning, new barrel |
| System K: FP + Particulate 0 over Bare Case | 2 | N | 2497.4 | 2492.4 | 5.0 | | | Normal case no burning |
| System K: FP + Particulate 0 over Bare Case | 3 | N | 2492.3 | 2487.3 | 5.0 | | | Normal case no burning |
| Control 2: Type III Anodized w/Std. Sealant | 1 | S | 2451.5 | 2453.6 | −2.1 | −1.8 | 1 | Baseline - some hole erosion, no burning |
| Control 2: Type III Anodized w/Std. Sealant | 2 | S | 2452.5 | 2450.2 | 2.3 | | | Some flash w/ light burning along case wall and around ejector groove |
| Control 2: Type III Anodized w/Std. Sealant | 3 | S | 2468.5 | 2471.4 | −2.9 | | | No flash, some cratering @hole edge, no burning |
| Control 2: Type III Anodized w/Std. Sealant | 4 | S | 2461.2 | 2463.7 | −2.5 | | | No flash, more cratering @hole edge than 3, no burning, starting to see erosion in chamber embossed on cartridge around hole |
| Control 2: Type III Anodized w/Std. Sealant | 5 | S | 2453.3 | 2456.3 | −3.0 | | | Some flash, distinct chamfer from erosion around hole edge, no damage to ejector groove |
| Control 2: Type III Anodized w/Std. Sealant | 6 | S | 2460.1 | 2462.8 | −2.7 | | | No flash, some cratering, incipicent melting and minor grooving @hole, most severe HS fired |
| Control 1: Bare Case | 1 | S | 2442.0 | 2287.5 | 154.5 | 154.5 | 157 | Baseline - extensive burning |
| System K: FP + Particulate 0 over Bare Case (Particulate 3 = hBN (1106) | 1 | S | 2520.6 | 2510.0 | 10.6 | 17.9 | 9 | Near perfect coating erosion w/no burn. Coating sag @ head near flow path 1st fired this barrel |

-continued

Table of Weight Losses for 5.56 mm Firing Trials

| Coating | # in group | Hole | Weight before (mg) | Weight after (mg) | Weight loss (mg) | Avg within group | Weight loss (-baseline) | Notes and Visual Observations |
|---|---|---|---|---|---|---|---|---|
| System K: FP + Particulate 0 over Bare Case | 2 | S | 2507.0 | 2455.5 | 51.5 | | | Flash & Some burning at exact pattern of previous shot - believed due to firing @ same clock position w/pre-existing groove in chamber 2nd case fired - Outlier |
| System K: FP + Particulate 0 over Bare Case | 3 | S | 2506.6 | 2495.3 | 11.3 | | | no flash - slight even erosion of coating and substrate around hole edge. No burning 1st fired in this barrel (new barrel) |
| System K: FP + Particulate 0 over Bare Case | 4 | S | 2499.3 | 2383.3 | 116.0 | | | flash - could have switched over into groove from previous shot - Outlier |
| System K: FP + Particulate 0 over Bare Case | 5 | S | 2594.5 | 2562.8 | 31.7 | | | no flash |
| Control 2: Type III Anodized w/Std. Sealant | 1 | L | 2442.0 | 2436.6 | 5.4 | 36.3 | 39 | Baseline - slight burning around hole edge, along sidewall and ejector groove. (new barrel) |
| Control 2: Type III Anodized w/Std. Sealant | 2 | L | 2462.1 | 2398.6 | 63.5 | | | Burning from distorted, enlarged, hole and case sidewall. Ejector land removed beneath plasma flowpath. |
| Control 2: Type III Anodized w/Std. Sealant | 3 | L | 2449.2 | 2409.3 | 39.9 | | | Similar damage to #2, but also transverse crack in case above hole approx 0.7 inches from head. |
| Control 2: Type III Anodized w/Std. Sealant | 4 | L | 2419.6 | 2360.8 | 58.8 | | | Worst damage - fired later, out of sequence, in oversized chamber. Gas enlarged hole going forward, as well as rearward. Considered an outlier (chamber was oversized) |
| Control 1: Bare Case | 1 | L | 2443.8 | 2277.0 | 166.8 | 166.8 | 169 | Baseline - extensive burning |

-continued

Table of Weight Losses for 5.56 mm Firing Trials

| Coating | # in group | Hole | Weight before (mg) | Weight after (mg) | Weight loss (mg) | Avg within group | Weight loss (-baseline) | Notes and Visual Observations |
|---|---|---|---|---|---|---|---|---|
| System K: FP + Particulate 0 over Bare Case | 1 | L | 2511.1 | 2398.5 | 112.6 | 37.9 | 29 | 3rd in order of thickness, order of firing. Outsize chamber. Rejected as an outlier (chamber oversized) |
| System K: FP + Particulate 0 over Bare Case | 2 | L | 2532.1 | 2481.8 | 50.3 | | | 2nd in order of firing. Burning along case sidewall and ejector groove. Shot was on last "clean" segment of chamber wall, possible explanation - plasma jet may have broken out and into an adjacent groove in chamber. |
| System K: FP + Particulate 0 over Bare Case | 3 | L | 2555.2 | 2529.6 | 25.6 | | | 1st in order of firing, selection based on coating thickness. Successful. Very little burning, some erosion around hole edge. |

Without being bound by a particular mechanism or theory, it is believed that as the ceramic additive (e.g. hBN) has a higher melting point than the conformal coating (fluoropolymer coating) the additive is configured to remain intact at a higher temperature (e.g. firing event) and/or sublimate at high temperatures to remove heat of condensation in the firing zone (e.g. within the chamber) to confer a thermal protection benefit to the underlying substrate.

Without being bound by a particular mechanism or theory, in this kind of mixture (i.e. coating with lower melting point and ceramic additive with higher melting point), the benefits of the added ceramic are believed to be conferred to the mixture in a manner akin to a "mixture rule", where the bulk properties like melting point, thermal conductivity, emissivity, etc., are a combination of these properties of the base coating (matrix) and of the particle, more or less in proportion to the relative amounts of each component (e.g. and, may be generally isotropic and non-directionally oriented or randomly and non-directionally aligned). For example, hBN has a melting temperature at approximately 3000° C., depending on pressure. At standard atmospheric pressure, it sublimates at a temperature of 2973° C. (5383° F.). At elevated pressures of 6 GPa (870226 psi), hBN melts at 3227° C. (5840° F.).

Without being bound by a particular mechanism or theory, it is believed that hBN's ability (in certain forms) to lay in a substantially flat configuration along the surface of the substrate, such that the plates are configured in a substantially parallel direction to the surface of the substrate is believed to provide the least quantity of heat conduction into the substrate (e.g. heat from the gas stream) as compared to other configurations/alignments.

Without being bound by a particular mechanism or theory, it is believed that the alignment configuration of the ceramic additives (e.g. hBN in plate-like configuration) is believed to increase the amount of thermal protection (i.e. insulation) imparted by the coating on the substrate, as compared to amount of thermal protection imparted in a coating having ceramic additives in a randomly oriented plate/flake-like configuration.

Example 3: hBN Varieties in Coating Systems, Applied to AA 6061 Panels

In order to evaluate the effectiveness of hexagonal boron nitride as a constituent to the cartridge casings, panel tests were completed, in which hBN was added to the fluoropolymer resin solids (hBN at 35 wt % of the FP resin solids). The ability to mix hBN into the coatings was evaluated, as well as application over aluminum panels (only surface-cleaned). The coated panel specimens were evaluated for coating uniformity using SEM, pencil hardness, and abrasion resistance tests. For Trials 1-6 set out below, each AA 6061 panel was cleaned prior to coating application.

For Trial #1, the coating was an 80/20 mix by volume of Fluoropolymer coating (PPG 1HC5697Durabrite C high gloss clear Fluoropolymer) to MIBK. A vortex mixer was utilized to mix the boron nitride powder into the coating. The 6061 panel was hand-dipped once and flashed off for one minute prior to oven cure. Cure was completed in an electric oven set at 390° F. for 2 minutes.

For Trial #2, the coating was 4.60 grams of hBN powder (PUHP500, Saint Gobain) mixed into 30mLs coating (13.214 grams of fluoropolymer resin solids) coating/7.5 mLs MIBK. A vortex mixer was utilized to mix the boron nitride powder into the coating. The 6061 panel was hand-dipped once and flashed off for one minute prior to oven cure. Cure was completed in an electric oven set at 390° F. for 2 minutes.

For Trial #3, the coating was 4.60 grams hBN powder (PUHP1106, Saint Gobain) mixed into 30 mls (13.214 grams of fluoropolymer resin solids)] coating/7.5 mL MIBK. A vortex mixer was utilized to mix the boron nitride powder into the coating. The 6061 panel was hand-dipped once and flashed off for one minute prior to oven cure. Cure was completed in an electric oven set at 390° F. for 2 minutes.

For Trial #4, the coating was 4.60 grams of hBN powder (PEG Dimethicone Treaded LEAU500, Saint Gobain) mixed into 30 mLs coating (13.214 grams of fluoropolymer resin solids)/7.5 mLs MIBK. A vortex mixer was utilized to mix the boron nitride powder into the coating. The 6061 panel was hand-dipped once and flashed off for one minute prior to oven cure. Cure was completed in an electric oven set at 390° F. for 2 minutes.

For Trial #5, the coating was a combination of fluoropolymer coating (PPG 1HC5697, Durabrite C high gloss clear Fluoropolymer)/Silicone coating (Dow Corning 1-2577 clear RTV)/MIBK in the ratio of 30/5/25 mLs. A vortex mixer was utilized to mix the boron nitride powder into the coating. The 6061 panel was hand-dipped once and flashed off for one minute prior to oven cure. Cure was completed in an electric oven set at 390° F. for 2 minutes.

For Trial #6, the coating was 4.60 grams of hBN powder (PEG Dimethicone Treaded LEAU500, Saint Gobain) mixed into PPG/Dow/MIBK 30/5/25 mLs, by volume. A vortex mixer was utilized to mix the boron nitride powder into the coating. The 6061 panel was hand-dipped once and flashed off for one minute prior to oven cure. Cure was completed in an electric oven set at 390° F. for 2 minutes, and after cure, the coating was inspected and confirmed.

Scratch Resistance Tests were completed in accordance with general industry practices (using a taber linear-abrasion) and test results are depicted in the table below. For each scratch resistance test, a single 2 inch stroke was done (per weight) and evaluated with copper sulfate for coating break through. An acidified copper sulfate was completed on each sample for 5 minutes to verify break through. It was observed that break through diminished as the coating weight increased vs. different loading. It was observed that the coating with silicone added in (silicone+fluoropolymer) had less scratch resistance than the fluoropolymer coating. It was observed that the hBN additive of LEAU 500 did not appear to reduce scratch resistance as compared to no additive. It was observed that both coatings with the PUHP500 & LEAU500 hBN additives provided roughly equivalent scratch resistance as compared to the coating of Fluoropolymer (without hBN). It was observed that the coating with hBN additive PUHP1106 started to show coating break-through at 800 grams of weight.

TABER LINEAR ABRASER Model 5750 - Single scratch test with 1 mm tip

| | | | spline + support + scratch tip + extra weight | weights added | Fluoro-polymer/ Solvent mix 80/20 | Fluoro-polymer/ Silicone/ Solvent mix 30/5/25 | Fluoro-polymer/ Silicone/ Solvent/ LEAU 500 mix 30/5/25 | Fluoro-polymer/ Solvent/ PUHP 500 mix 80/20 | Fluoro-polymer/ Solvent/ LEAU 500 mix 80/20 | Fluoro-polymer/ Solvent/ PUHP 1106 mix 80/20 |
|---|---|---|---|---|---|---|---|---|---|---|
| | | | | | Coating thickness range top to bottom in mils | | | | | |
| N (kg-m/s$^2$) | g (m/s$^2$) | m (kg) | m (g) | add g | .60-1.14 | .55-.89 | .64-.94 | .83-1.74 | .67-1.39 | .57-1.12 |
| 2.6 | 9.81 | 0.26 | 261.60 | | no scratch | NO testing done | | | | |
| 3.1 | 9.81 | 0.31 | 311.60 | +50 | no scratch | | | | | |
| 3.5 | 9.81 | 0.36 | 361.60 | +100 | no scratch | | | | | |
| 4.0 | 9.81 | 0.41 | 411.60 | +150 | no scratch | | | | | |
| 5.0 | 9.81 | 0.51 | 511.60 | +250 | no scratch | | | | | |
| 5.5 | 9.81 | 0.56 | 561.60 | +300 | no scratch | | | | | |
| 6.0 | 9.81 | 0.61 | 611.60 | +350 | no scratch | | | | | |
| 6.5 | 9.81 | 0.66 | 661.60 | +400 | scratch | | | | | |
| 7.5 | 9.81 | 0.76 | 761.60 | +500 | scratch | | | | | |
| 8.0 | 9.81 | 0.81 | 811.60 | +550 | scratch | | | | | |
| 8.5 | 9.81 | 0.86 | 861.60 | +600 | scratch | scratch & coating break through | scratch & coating break through | scratch | scratch | scratch |
| 8.9 | 9.81 | 0.91 | 911.60 | +650 | scratch | scratch & coating break through | scratch & coating break through | scratch | scratch | scratch |
| 9.9 | 9.81 | 1.01 | 1011.60 | +750 | scratch | scratch & coating break through | scratch & coating break through | scratch | scratch | scratch |
| 10.4 | 9.81 | 1.06 | 1061.60 | +800 | scratch | scratch & coating break through | scratch & coating break through | scratch | scratch | scratch & coating break through |
| 10.9 | 9.81 | 1.11 | 1111.60 | +850 | scratch | scratch & coating break through | scratch & coating break through | scratch | scratch | scratch & coating break through |
| 11.4 | 9.81 | 1.16 | 1161.60 | +900 | scratch | scratch & coating break through | scratch & coating break through | scratch | scratch | scratch & coating break through |

Example 4: Coefficient of Friction Tests, Fluoropolymer, hBN, Bare Aluminum

Coefficient of Friction (CoF) tests were completed on four coating systems and a bare aluminum surface (control). The samples were tested in the rolling direction with a load of 1000 grams. The speed was set at 20% of maximum and the bridge amplifier with a 100% load at full scale. The paper speed setting is 5 centimeters per second.

| Sample | Identification | Units | Calculation | Coefficient of Friction |
|---|---|---|---|---|
| 1 (control*) | Standard fluropolymer bare | 10 | 400 | 0.4 |
| 2 | Standard fluoropolymer | 6 | 240 | 0.24 |
| 3 | LEAU 500 | 3 | 120 | 0.12 |
| 4 | PUHP 500 | 4.5 | 180 | 0.18 |
| 5 | PUHP 1106 | 7 | 280 | 0.28 |

Control *: refers to the control for the abrasion and friction tests, which is fluoropolymer over aluminum (with no hBN added to the fluoropolymer).

Example 5: Simulation of Thermal Model During Firing Event

A one-dimensional thermal model was created in order to predict/project the ability of coatings to survive a firing event. Variables including: coating thickness, coating components, metal substrate, etc. were incorporated into a mathematical model and graphs for various coating systems were plotted, in temperature vs. time according to the firing event's predicted thermal event and firing duration. The goal was for the coating system to protect the underlying metal (aluminum substrate) for a long enough duration and from the full thermal event such that the coating system imparted some protection/barrier to the underlying substrate material during the firing event (e.g. to prevent degradation/a burn through event, in the case of certain substrate materials).

Regarding the simulation, without being bound by any particular mechanism or theory, the flow of propellant gases is estimated using compressible gas flow theory, with the assumption that the flow of gas is a choked flow of propellant gases through the hole. This theory determines the gas properties along the length of the hole: temperature, pressure, density, and velocity. Convective and radiation heat transfer are then estimated using the flow conditions within the hole.

Without being bound by any particular mechanism or theory, it is believed that radiation heat transfer is insignificant as compared to convective heat transfer, and it is possible to estimate the heat transfer from the propellant gases in the drilled hole experiment from the chamber conditions: temperature, pressure, and gas composition.

During the firing event for a 5.56 mm case, the case pressure rises from atmospheric pressure to its maximum pressure 0.7 ms after ignition, then the case pressure decreases to atmospheric pressure 2.2 ms after ignition. The pressure-time trajectory is known, and the peak pressure of the case may be in the range from 50000 psi to 70000 psi.

Figure 9:
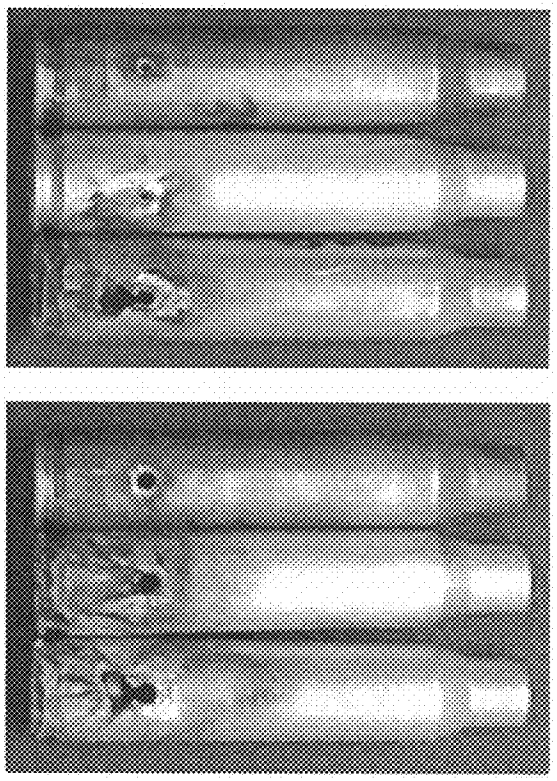
FIG. 9 depicts images of cases fired in the drilled hole experiment for a 0.025 inch hole and a 0.0625 inch hole for a bare brass case, a type III anodized aluminum case and a bare aluminum case to depict relevant comparative burn through and erosion observable with various embodiments and controls in accordance with the instant disclosure.

Published heat transfer estimates were coupled with a one-dimensional computational heat conduction model and compared with published test results comparing brass to anodized aluminum to bar aluminum cartridge cases (in order to establish validity of the model with actual test data). FIG. 9 shows images of cases fired in the drilled hole experiment for a 0.025 inch hole and a 0.0625 inch hole for a bare brass case, a type III anodized aluminum case and a bare aluminum case. As depicted in FIG. 9, the brass case remained intact for both hole sizes. As shown in FIG. 9, the anodized aluminum case remained intact for the 0.025 inch hole, but had significant melting for the 0.0625 inch hole. As shown in FIG. 9, the bare aluminum case showed significant melting for both hole sizes.

Without being bound by a particular mechanism or theory, the model calculates the transient temperature response within the coating and case material, which is used to determine the time for the case to heat and begin to melt during a firing event. Results from the model can be calibrated to test data and used to compare different case materials, coating materials and coating thicknesses, and predict the success of other case materials, coating materials and thicknesses.

The table below compares the model prediction with the test observations (e.g. depicted in FIG. 9). The bare brass case is used as a baseline and is regarded as having adequate performance for the drilled hole test. It is important to note that the propellant gas temperature is so high that, via the model, both the aluminum and brass cases are predicted to melt before the firing event is complete, less than 2.2 ms, given unobstructed flow for the entire duration of the test. As stated earlier, the flow through the drilled hole may be reduced if the case does not melt before the peak pressure at 0.7 ms. The model predicted that the type III anodized case, having a coating thickness of 0.0007 inches, has a time to initiate melting shorter than bare brass. Finally, the model predicted that the bare aluminum case has the shortest time to initiate melting.

The published data from the firing trial suggests there is a threshold between 0.50 ms and 0.63 ms, where case melting increases dramatically.

In the table below, the published test observations are compared with the predictions from the thermal model. As depicted below, shorter time to initiate melting corresponds to case melting, and longer time to initiate melting corresponds to the case being intact after the drilled hole test.

Figure 10:
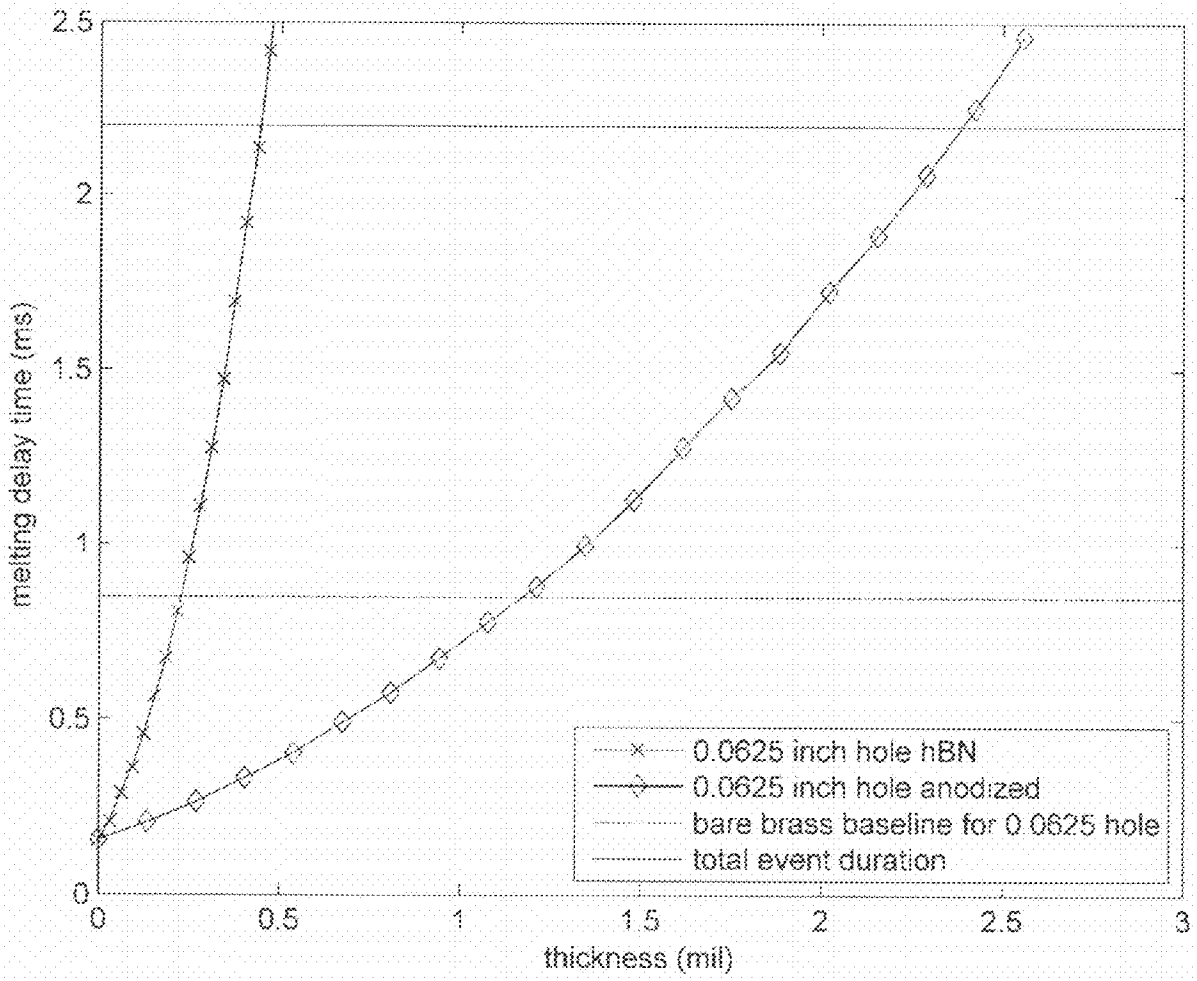
FIG. 10 depicts a chart plotting the melting delay time as a function of coating thickness for two casings constructed of the same aluminum alloy and each having a 0.0625 inch hole (e.g. simulating a worst-case scenario, large manufacturing defect in the case), in accordance with various embodiments of the instant disclosure.
Figure 11:
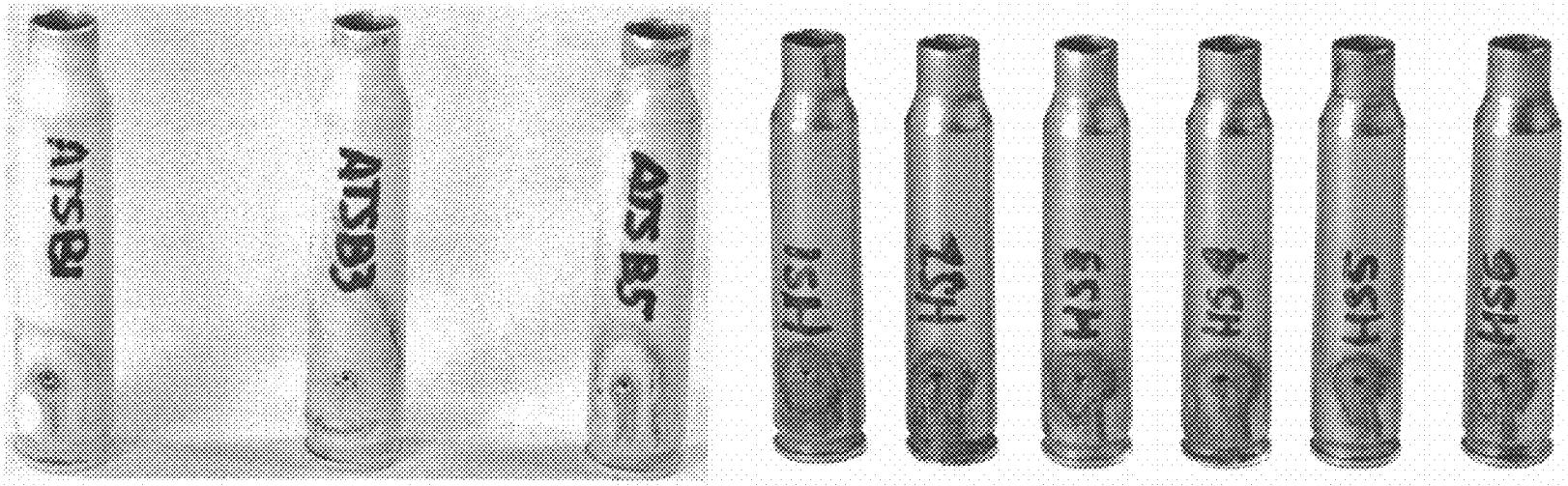
FIG. 11 depicts erosion of the coating for System C (e.g. fluoropolymer with 45 wt. % hBN) in the area between the hole and the case groove, which is illustrated in the fired cases in accordance with various embodiments of the instant disclosure. Without being bound by a particular mechanism or theory, The coating is depleted during the firing event and substrate is exposed near the intentional damage (drilled hole) on cases marked ATSB1 and ATSB5. Most of the Type III anodized cases show little burning or erosion of the coating except HS2, which burned.
Figure 12:
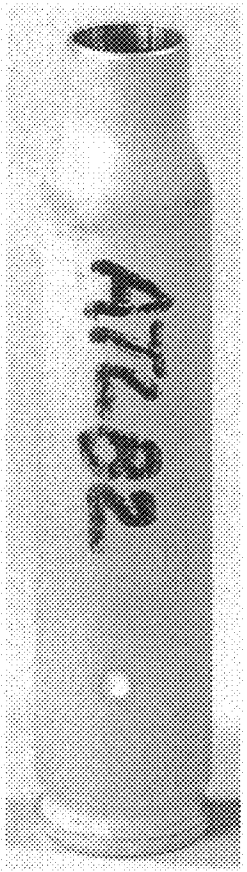
FIG. 12 illustrates variabilities encountered in the application of the fluoropolymer with hBN coatings (labeled as ATB coating) in accordance with various embodiments of the instant disclosure. Case ATLB6 is shown after firing, with relatively thick coverage of the entire case (even near the damage/drilled hole to simulate a manufacturing defect) with the coating, and successful result (i.e. case protected, no burn-through event). Case ATLB2 before firing, illustrating thin coating near the damage (intentionally drilled hole).
Figure 12:
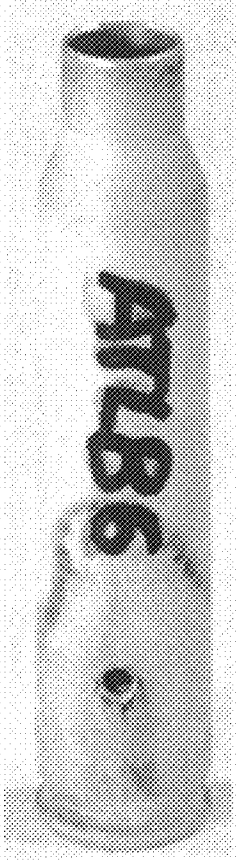

The model was used to identify alloys, coating materials and their thickness that would prevent melting to the same capacity as bare brass. FIG. 10 depicts a chart plotting the melting delay time as a function of coating thickness for two casings constructed of the same aluminum alloy and each having a 0.0625 inch hole (e.g. simulating a worst-case scenario, large manufacturing defect in the case). One case included a coating system having hexagonal boron nitride therein and the other casing had an anodized coating (Type III anodized coating). Also depicted in FIG. 10 are the bare brass baseline and the total event duration. From FIG. 10, it is predicted that the anodized coating of 1.25 mil would be required to meet the same melting delay time as for the bare brass case, and 2.4 mil to last the entire duration of the firing event. FIG. 10 predicts that the boron nitride coating has the potential to exceed the performance of both brass and an anodized coating, where a coating of only 0.5 mil is predicted to provide sufficient protection to the aluminum case for the entire duration of the firing event.

In some embodiments, the coating comprises a thermal diffusivity of not greater than $5\times10^{-6}$ $m^2/s$. In some embodiments the coating comprises a maximum temperature of not greater than 2000K.

Without being bound by a particular mechanism or theory, although the adiabatic flame temperature for the propellant gases, typically 3000 K, may be substantially high than the maximum temperature of the coating, it is believed that the duration of heat transfer (during the firing event) is not long enough for the temperature of the coating to heat beyond its upper limit.

While various embodiments of the present invention have been described in detail, it is apparent that modifications and adaptations of those embodiments will occur to those skilled in the art. However, it is to be expressly understood that such modifications and adaptations are within the spirit and scope of the present invention.

EMBODIMENTS

Embodiment 1

An apparatus, comprising: a substrate configured into a casing, the casing having at least one sidewall such that the casing includes an inner sidewall and an outer sidewall, the casing configured such that it has two opposing ends: a first end and a second end;

a projectile configured to sit within and be retained by the casing and positioned adjacent to the first end; a propellant, the propellant configured between the projectile and the second end of the casing, the propellant configured to expand upon a firing event and project the projectile from the casing; and a coating comprising a conformal coating layer having a particulate boron nitride [dispersed] therein, wherein the coating is configured to cover at least one of the inner sidewall and the outer sidewall, such that at least one side of the substrate is covered by the coating.

In some embodiments, the coating is configured cover the inner sidewall and outer sidewall of the casing such that the casing is encased within the coating.

In some embodiments, the casing comprising an ammunition casing

In some embodiments, the casing comprises an ammunition casing of: 5.56 mm NATO; .223 Remington; 9 mm; .40 Caliber S&W; or a .45 ACP.

In some embodiments, the casing comprising a cartridge for squib for a power tool.

In some embodiments, the substrate is selected from the group consisting of: aluminum, aluminum alloys (e.g. 2xxx, 6xxx, and 7xxx series aluminum alloys, 2024, 6055, 7075, 7085), magnesium, titanium, steel, plastic, and polymers.

In some embodiments, the substrate comprises a pipe (e.g. mining pipe, chemical pipe).

In some embodiments, the substrate comprises an air bags assembly.

Embodiment 2

An apparatus, comprising: a substrate configured into a casing, the casing having at least one sidewall such that the casing includes an inner sidewall and an outer sidewall, the casing configured such that it has two opposing ends: a first end and a second end; a projectile configured to sit within and be retained by the casing and positioned adjacent to the first end; a propellant, the propellant configured between the projectile and the second end of the casing, the propellant configured to expand upon a firing event and project the projectile from the casing; and a coating comprising a fluoropolymer layer having a particulate boron nitride [dispersed] therein, wherein the coating is configured to cover at least one of the inner sidewall and the outer sidewall, such that at least one side of the substrate is covered by the coating.

Embodiment 3

An apparatus, comprising: an ammunition cartridge casing comprising a substrate configured to retain a projectile and a propellant, wherein the ammunition cartridge casing is configured with a coating thereon, wherein the coating includes: a fluoropolymer portion and an additive configured to be dispersed within the fluoropolymer portion.

In some embodiments, the fluoropolymer portion is configured to cover the substrate (e.g. completely encase the substrate).

In some embodiments, the additive comprises a ceramic additive.

In some embodiments, the ceramic additive is selected from the group consisting of: alumina, boron nitride, titania, and combinations thereof.

In some embodiments, the additive is present in a range of: at least 5 wt. % to not greater than 70 wt. %.

In some embodiments, the casing (ammunition cartridge with coating) is capable of withstanding pressure during a firing event yielding a pressure of at least 40 ksi.

In some embodiments, the casing (ammunition cartridge with coating) is capable of withstanding a firing event duration of at least 2.2 ms.

In some embodiments, the ammunition cartridge casing is capable of withstanding a temperature during a firing event of not greater than 3000 C.

In some embodiments, the coating is a sacrificial coating (i.e. is lost/burned off as a result of the firing event).

In some embodiments, the coating is configured on the outside of the case.

In some embodiments, the coating is configured on the inside of the case.

In some embodiments, the coating is configured to encase the substrate (e.g. completely cover and surround the inside, outside, and upper lip/opening, along with base of the case).

In some embodiments, the additive comprises a ceramic particulate material.

In some embodiments, the additive is selected from the group: alumina, titania, zirconia, boron nitride, cubic boron nitride, hexagonal boron nitride, boron nitride polymorphs, and combinations thereof. In some embodiments, the additive is surface treated. In some embodiments, the additive is surface treated with a polymer. In some embodiments, the additive is surface treated with a silicone based polymer and/or a polymethyl siloxane based polymer, where the polymer(s) is/are configured to cooperate with the coating and the substrate to promote a coated substrate having an surface-treated additive therein. Some non-limiting examples of silicone-based polymers (e.g. utilized with BN-additives include dimethicone (e.g. hydrophilic or hydrophobic dimethicone), methicone, and combinations thereof).

In some embodiments, the additive comprises uniformly sized granules.

In some embodiments, the additive comprises non-uniformly sized granules.

In some embodiments, the coating thickness ranges from 0.25 mil to 2.0 mil thick.

In some embodiments, the additive comprises a spherical shape.

In some embodiments, the additive comprises a plate-like shape.

In some embodiments, the additive comprises a polygonic cube.

In some embodiments, the additive comprises a prismatic shape (e.g. with an aspect ratio of approximately 1.0).

In some embodiments, the additive comprises a whisker shape (e.g. thin-rod shaped).

In some embodiments, the additive comprises a discoidal shape (e.g. circular flat shape).

In some embodiments, via visual observation, the casing does not exhibit a burn through event.

In some embodiments, via visual observation, the casing does not exhibit burning.

In some embodiments, via visual observation, the casing does not exhibit erosion.

In some embodiments, via visual observation, the casing does not exhibit melting.

In some embodiments, the coating is configured to insulate the substrate from the heat and pressure of the firing event.

In some embodiments, the coating is configured to isolate the substrate from contact with the gas released during the firing event (i.e. gas caused by ignition of propellant).

In some embodiments, the coating comprises an organic conformal coating.

In some embodiments, the coating comprises a fluoropolymer.

In some embodiments, the coating comprises a fluoropolymer; a solvent, and at least one additive.

Embodiment 4

An apparatus, comprising: a cartridge case comprising a substrate (e.g. Al, Ti, brass, steel, plastic), the cartridge case having: a base, a perimetrical sidewall configured to surround the base and extend upward from the base, and an open, upper end, and a coating on the base and the perimetrical sidewall of the cartridge case; wherein, via the coating, the cartridge case does not exhibit burn-through during a firing event that has a duration of greater than two milliseconds, where the firing event produces a gas having pressure of at least 40 ksi and a temperature not greater than 3000° C.

Embodiment 5

A method, comprising: forming a cartridge casing from a substrate material to provide a body having at least one sidewall, the cartridge casing having a first end and a second end, wherein the cartridge casing is configured to retain a projectile and a propellant; coating a cartridge casing with a layer of fluropolymer including a ceramic particulate dispersed therein; drying (curing) the coating to remove a solvent from the coating and set the coating onto the surface of the substrate (e.g. inner sidewall and/or outer sidewall); positioning the propellant and the projectile within the casing; forming an ammunition cartridge.

In some embodiments, coating comprises: spraying, dipping, brushing/painting, rolling, and combinations thereof.

In some embodiments, the method comprises cleaning the surface of the substrate prior to coating the substrate with a fluoropolymer.

In some embodiments, the method comprises deoxidizing the surface of the substrate (e.g. when the substrate is an aluminum alloy) prior to coating the substrate with a fluoropolymer.

In some embodiments, the coated case comprises: a chemical compatibility (i.e. between the coating and the propellants retained in the case (charge and primer)).

In some embodiments, the coated case comprises: a corrosion resistance (e.g. measured as a shelf life and/or resistance to moisture-rich environment).

In some embodiments, the coated case comprises: a coefficient of friction sufficient to reduce, prevent, and/or eliminate galling and/or spalling of the barrel and/or case. In some embodiments, when the coated case comprises an aluminum alloy substrate, the coefficient of friction is less than 0.45.

In some embodiments, the coated case comprises: a thermal resistance (i.e. sufficient to withstand storage at hot temperatures, fire resistance, and/or being loaded into a firearm with a preheated barrel (e.g. through repeated, previous firing events)).

In some embodiments, the coated case comprises: a propellant resistance (i.e. does not undergo corrosion and/or degradation when in contact with the powder/charge).

In some embodiments, the coated case comprises: a waterproof case capable of being immersed/submerged in a liquid (water) without losing its ability to fire (i.e. primer, charge, and case components remain intact). In some embodiments, the coated case comprises an abrasion resistance (as measured in the coating or in the ability of the coating to reduce, prevent, and/or eliminate abrasion of the underlying substrate (case).

In some embodiments, the coating is configured to protect a substrate material (e.g. metal, polymer) during a short duration, high temperature heating event (e.g. rifle shot).

In some embodiments, the casing components (coating and substrate material) are specifically configured as a system. In some embodiments, the substrate material is configured to provide mechanical strength (e.g. strength, stiffness, fracture toughness and other mechanical properties) while the coating (e.g. including ceramics or ceramic composite materials) is configured to provide thermal protection and chemical protection to the substrate (e.g. thermal insulating, corrosion resistant and abrasion resistant properties).

In some embodiments, the substrate comprises a thermal limit below the temperature of the firing event. However, the system/combination of substrate and coating material is sufficient to reduce, prevent, and/or eliminate heating the substrate to its thermal limit during the short duration of the firing event.

In some embodiments, the coating thickness is engineered to maintain the substrate temperature low enough during the firing event to prevent it from degrading.

What is claimed is:

1. An apparatus, comprising:

an aluminum substrate configured into a casing, the casing having at least one sidewall such that the casing includes an inner sidewall and an outer sidewall, the casing configured such that it has two opposing ends comprising a first end and a second end;

a projectile configured to sit within and be retained by the casing and positioned adjacent to the first end;

a propellant, the propellant configured between the projectile and the second end of the casing, the propellant configured to expand upon a firing event and project the projectile from the casing; and a coating comprising a conformal coating layer having a fluoropolymer and a particulate hexagonal boron nitride therein, wherein the hexagonal boron nitride is PUHP 1106 hexagonal boron nitride configured in a flat plate configuration parallel to a surface of the substrate;

wherein the coating is configured to cover at least one of the inner sidewall and the outer sidewall, such that at least one side of the substrate is covered by the coating; wherein via the hexagonal boron nitride configuration, the substrate with the coating is configured for the firing event.

2. The apparatus of claim 1, wherein the coating is configured to cover the inner sidewall and the outer sidewall of the casing such that the casing is encased within the coating.

3. The apparatus of claim 1, wherein the casing comprises an ammunition casing.

4. The apparatus of claim 1, wherein the casing comprises an ammunition casing of: 5.56 mm NATO; .223 Remington; 9 mm; .40 Caliber S&W; or a .45 ACP.

5. The apparatus of claim 1, wherein the casing comprising a cartridge for squib for a power tool.

6. The apparatus of claim 1 wherein the substrate is selected from the group consisting of: aluminum, aluminum alloys 2xxx, 6xxx, and 7xxx series aluminum alloys, 2024, 6055, 7075, 7085, magnesium, titanium, steel, plastic, and polymers.

7. An apparatus, comprising:

a substrate configured into a casing, the casing having at least one sidewall such that the casing includes an inner sidewall and an outer sidewall, the casing configured such that it has two opposing ends comprising a first end and a second end;

a projectile configured to sit within and be retained by the casing and positioned adjacent to the first end;

a propellant, the propellant configured between the projectile and the second end of the casing, the propellant configured to expand upon a firing event and project the projectile from the casing; and a coating comprising a fluoropolymer layer having a particulate hexagonal boron nitride therein, wherein the coating comprises a fluoropolymer portion and at least 30 wt. % to not greater than 70 wt. % of the particulate hexagonal boron nitride configured to be dispersed within the fluoropolymer portion wherein the hexagonal boron nitride is configured in a flat plate configuration parallel to a surface of the substrate, wherein the coating is configured to cover at least one of the inner sidewall and the outer sidewall, such that at least one side of the substrate is covered by the coating.

8. An apparatus, comprising:

an ammunition cartridge casing comprising an aluminum substrate configured to retain a projectile and a propellant, wherein the ammunition cartridge casing is configured with a coating thereon, wherein the coating includes: a fluoropolymer portion and at least 30 wt. % to not greater than 70 wt. % of a hexagonal boron nitride additive configured to be dispersed within the fluoropolymer portion wherein the hexagonal boron nitride is configured in a flat plate configuration parallel to the surface of a substrate;

wherein the coating is configured to cover at least one of an inner sidewall and an outer sidewall of the ammunition cartridge casing, such that at least one side of the aluminum substrate is covered by the coating; wherein via a configuration of the hexagonal boron nitride additive, the aluminum substrate with the coating is configured for a firing event yielding a pressure of at least 40 ksi for a duration of at least 2.2 ms.

9. The apparatus of claim 8, wherein the fluoropolymer portion is configured to cover the substrate by completely encasing the substrate.

10. The apparatus of claim 8, wherein the ammunition cartridge casing is capable of withstanding a temperature during the firing event of not greater than 3000° C.

11. The apparatus of claim 8, wherein the coating is a sacrificial coating configured to be lost, burned off, or removed from the substrate as a result of the firing event.

12. The apparatus of claim 8, wherein the coating is configured on an outside of the ammunition cartridge casing.

13. The apparatus of claim 8, wherein the coating is configured on an inside of the ammunition cartridge casing.

14. The apparatus of claim 8, wherein the coating is configured to encase the substrate by completely covering and surrounding an inside, an outside, and an upper lip/opening, along with a base of the ammunition cartridge casing.

15. The apparatus of claim 8, wherein the hexagonal boron nitride additive is surface treated.

16. The apparatus of claim 8, wherein via a visual observation, the ammunition cartridge casing does not exhibit at least one of: a burn through event; a burning; an erosion; a melting; and combinations thereof, as qualified via the visual observation after the firing event.

17. The apparatus of claim 8, wherein the coating is configured to insulate the substrate from a heat and a pressure of the firing event.

18. The apparatus of claim 8, wherein the coating is configured to isolate the substrate from contact with a gas released during the firing event.

19. The apparatus of claim 8, wherein the coating comprises an organic conformal coating.

20. The apparatus of claim 8, wherein the coating comprises a fluoropolymer; a solvent, and at least one additive.

21. An apparatus, comprising:

a cartridge case comprising an aluminum substrate formed of the cartridge case having: a base, a perimetrical sidewall configured to surround the base and extend upward from the base, and an open, upper end, and a coating containing a fluropolymer and a 1106 hexagonal boron nitride, configuration, wherein the coating comprises at least 30 wt. % to not greater than 70 wt. % of the 1106 hexagonal boron nitride dispersed within the fluoropolymer portion, wherein the coating is configured to coat the substrate which forms the base and the perimetrical sidewall of the cartridge case; wherein, via the coating, the cartridge case does not exhibit burn-through during a firing event that has a duration of greater than two milliseconds, wherein the firing event produces a gas having pressure of at least 40 ksi and a temperature not greater than 3000° C.

22. A method, comprising:

forming a cartridge casing from a substrate material to provide a body having at least one sidewall, the cartridge casing having a first end and a second end, wherein the cartridge casing is configured to retain a projectile and a propellant;

coating the cartridge casing with a layer of a fluoropolymer including a hexagonal boron nitride ceramic particulate having a plate-like configuration dispersed therein, wherein the layer comprises at least 30 wt. % to not greater than 70 wt. % of the hexagonal boron nitride ceramic particulate configured to be dispersed within the layer;

drying the layer to remove a solvent from the layer and set the layer onto a surface of the cartridge casing, wherein the hexagonal boron nitride ceramic particulate is configured via the drying step into a configuration substantially parallel to the surface of the cartridge casing, wherein a thickness of the layer ranges from 0.25 mil to 2.0 mil;

positioning the propellant and the projectile within the cartridge casing; and forming an ammunition cartridge, wherein via the coating, the ammunition cartridge is configured to fire without galling a barrel of a firearm.

23. The method of claim 22, wherein drying comprises curing the layer.

24. The method of claim 22, wherein coating comprises: spraying, dipping, brushing/painting, rolling, and combinations thereof.

25. The method of claim 22, wherein the method comprises cleaning the surface of the cartridge casing prior to coating the cartridge casing.

26. The method of claim 22, wherein the method comprises deoxidizing the surface of the cartridge casing when the substrate material is an aluminum alloy prior to coating the cartridge casing with a fluoropolymer.

27. The method of claim 22, wherein the layer is chemically compatible with a propellant retained within the cartridge casing.

28. The method of claim 22, wherein the coated cartridge casing comprises: a corrosion resistance measured as a shelf life; a resistance to moisture-rich environment; and combinations thereof.

29. The method of claim 22, wherein the coated cartridge casing comprises: a coefficient of friction sufficient to reduce, prevent, and/or eliminate galling and/or spalling of the barrel and/or the cartridge casing.

30. The method of claim 22, wherein the substrate material is an aluminum alloy having a coefficient of friction of less than 0.45.

31. The method of claim 22, wherein the coated cartridge casing comprises: a thermal resistance sufficient to withstand storage at hot temperatures, a fire resistance, and/or being loaded into a firearm with a preheated barrel.

32. The method of claim 22, wherein the coated cartridge casing comprises: a propellant resistance such that the coated case does not undergo corrosion and/or degradation when in contact with the powder/charge.

33. The method of claim 22, wherein the coated cartridge casing comprises: a waterproof case capable of being immersed/submerged in a liquid without losing its ability to fire.

34. The method of claim 22, wherein the coated cartridge casing comprises an abrasion resistance as measured in the layer or in the ability of the layer to reduce, prevent, and/or eliminate an abrasion of the underlying substrate material.

35. The method of claim 22, wherein the layer is configured to protect a substrate material during a short duration, high temperature heating event.

* * * * *